US007846017B2

(12) United States Patent
Walker et al.

(10) Patent No.: US 7,846,017 B2
(45) **Date of Patent: *Dec. 7, 2010**

(54) METHODS AND APPARATUS FOR FACILITATING REMOTE VIEWING OF GAMING OUTCOMES

(75) Inventors: Jay S. Walker, Ridgefield, CT (US); Robert C. Tedesco, Fairfield, CT (US); James A. Jorasch, New York, NY (US); Jose A. Suarez, Fairfield, CT (US)

(73) Assignee: IGT, Reno, NV (US)

( * ) Notice: Subject to any disclaimer, the term of this patent is extended or adjusted under 35 U.S.C. 154(b) by 1372 days.

This patent is subject to a terminal disclaimer.

(21) Appl. No.: 11/327,215

(22) Filed: Jan. 6, 2006

(65) Prior Publication Data

US 2006/0148562 A1 Jul. 6, 2006

Related U.S. Application Data

(63) Continuation-in-part of application No. 10/885,570, filed on Jul. 6, 2004.

(60) Provisional application No. 60/644,184, filed on Jan. 14, 2005.

(51) Int. Cl.
*A63F 1/00* (2006.01)

(52) U.S. Cl. ..... 463/20; 463/17; 463/42

(58) Field of Classification Search ..... 463/17, 463/20, 25, 40–42; 380/251; 273/138.1, 273/139; 283/901; 713/178
See application file for complete search history.

(56) References Cited

U.S. PATENT DOCUMENTS 4,191,376 A 3/1980 Goldman et al. ..... 273/139
4,299,637 A 11/1981 Oberdeck et al. ..... 156/64
4,677,553 A 6/1987 Roberts et al. ..... 364/412
4,982,337 A 1/1991 Burr et al. ..... 365/479
5,178,389 A 1/1993 Bentley et al. ..... 273/138 A
5,216,595 A 6/1993 Protheroe ..... 364/412
5,277,424 A 1/1994 Wilms ..... 273/85 CP
5,290,033 A 3/1994 Bittner et al. ..... 273/138 A
5,344,144 A 9/1994 Canon ..... 273/138 A
5,377,975 A 1/1995 Clapper, Jr. ..... 273/138 A
5,551,692 A 9/1996 Pettit et al. ..... 273/143 R
5,569,082 A 10/1996 Kaye
5,709,603 A 1/1998 Kaye ..... 463/17
5,768,382 A 6/1998 Schneier et al.
5,800,268 A 9/1998 Molnick
5,830,067 A 11/1998 Graves et al.
5,908,354 A 6/1999 Okuniewicz (Continued)

OTHER PUBLICATIONS

"Kansas Lottery presents eScratch", [online], [retrieved Jun. 8, 2005], Retrieved from the Internet: <http://www.escratchks.com/escratch/postHome.do>.

(Continued)

*Primary Examiner*—Peter DungBa Vo
*Assistant Examiner*—Masud Ahmed
(74) *Attorney, Agent, or Firm*—K&L Gates LLP

(57) ABSTRACT

In accordance with some embodiments, a plurality of outcomes are generated for a wagering game. The plurality of outcomes are stored on a tangible medium (e.g., a DVD) or otherwise stored. The plurality of outcomes are sold to a player, for viewing by the player at a location remote from a casino.

19 Claims, 14 Drawing Sheets

U.S. PATENT DOCUMENTS

| | | | | |
|---|---|---|---|---|
| 5,988,688 | A | 11/1999 | Such | 283/100 |
| 6,007,426 | A | 12/1999 | Kelly et al. | |
| 6,012,983 | A | 1/2000 | Walker et al. | |
| 6,017,032 | A | 1/2000 | Grippo et al. | 273/138.1 |
| 6,077,163 | A | 6/2000 | Walker et al. | |
| 6,142,872 | A | 11/2000 | Walker et al. | |
| 6,146,276 | A | 11/2000 | Okuniewicz | |
| 6,173,267 | B1 | 1/2001 | Cairns | 705/14 |
| 6,309,298 | B1 | 10/2001 | Gerow | 463/20 |
| 6,508,709 | B1 | 1/2003 | Karmarkar | 463/42 |
| 6,634,942 | B2 | 10/2003 | Walker et al. | |
| 6,645,075 | B1 | 11/2003 | Gatto et al. | 463/25 |
| 6,709,331 | B2 | 3/2004 | Berman | 463/16 |
| 6,780,564 | B2 | 8/2004 | Lawandy et al. | 430/270.1 |
| 6,840,860 | B1 | 1/2005 | Okuniewicz | |
| 6,863,608 | B1 | 3/2005 | LeMay et al. | 463/24 |
| 6,884,170 | B2 | 4/2005 | Rowe | |
| 6,918,831 | B2 | 7/2005 | Nguyen et al. | 463/20 |
| 6,929,546 | B2 | 8/2005 | Moore et al. | 463/30 |
| 6,935,949 | B1 | 8/2005 | Murphy | 463/20 |
| 6,964,609 | B2 | 11/2005 | Haag et al. | 463/20 |
| 7,140,964 | B2 | 11/2006 | Walker et al. | |
| 7,188,186 | B1 | 3/2007 | Meyer et al. | |
| 7,233,922 | B2 | 6/2007 | Asher et al. | |
| 7,322,887 | B2 | 1/2008 | Belger et al. | |
| 2002/0090986 | A1 | 7/2002 | Cote et al. | |
| 2002/0169018 | A1 | 11/2002 | Schneier et al. | |
| 2003/0100357 | A1 | 5/2003 | Walker et al. | |
| 2003/0177347 | A1 | 9/2003 | Schneier et al. | |
| 2004/0022520 | A1 | 2/2004 | Kinzer et al. | 386/69 |
| 2004/0053675 | A1 | 3/2004 | Nguyen et al. | |
| 2004/0137987 | A1 | 7/2004 | Nguyen et al. | 463/42 |
| 2004/0147308 | A1 | 7/2004 | Walker et al. | |
| 2004/0152504 | A1 | 8/2004 | Herrmann et al. | 463/16 |
| 2004/0210507 | A1 | 10/2004 | Asher et al. | |
| 2004/0229677 | A1 | 11/2004 | Gray et al. | 463/17 |
| 2004/0235550 | A1 | 11/2004 | McNally et al. | 463/16 |
| 2005/0059493 | A1 | 3/2005 | Tyson et al. | 463/42 |
| 2005/0114272 | A1 | 5/2005 | Herrmann et al. | 705/67 |
| 2005/0119042 | A1 | 6/2005 | Chamberlain et al. | 463/19 |
| 2005/0130728 | A1 | 6/2005 | Nguyen et al. | 463/16 |
| 2005/0164779 | A1 | 7/2005 | Okuniewicz | |
| 2005/0170881 | A1 | 8/2005 | Muskin | 463/20 |
| 2005/0181854 | A1 | 8/2005 | Moshal | |
| 2005/0192087 | A1 | 9/2005 | Friedman et al. | 463/25 |
| 2005/0193209 | A1 | 9/2005 | Saunders et al. | 713/182 |
| 2005/0250567 | A1 | 11/2005 | Kane et al. | 463/16 |
| 2005/0250568 | A1 | 11/2005 | Kane et al. | |
| 2005/0250569 | A1 | 11/2005 | Kane et al. | |
| 2005/0250571 | A1 | 11/2005 | Kane et al. | |
| 2005/0250572 | A1 | 11/2005 | Kane et al. | |
| 2005/0250573 | A1 | 11/2005 | Kane et al. | |
| 2005/0250574 | A1 | 11/2005 | Kane et al. | |
| 2005/0250575 | A1 | 11/2005 | Kane et al. | |
| 2005/0250576 | A1 | 11/2005 | Kane et al. | |
| 2005/0277459 | A1 | 12/2005 | Haag et al. | 463/13 |
| 2006/0014579 | A1 | 1/2006 | Kane et al. | |
| 2006/0025197 | A1 | 2/2006 | Kane et al. | |
| 2006/0025213 | A1 | 2/2006 | Kane et al. | |
| 2006/0030388 | A1 | 2/2006 | Kane et al. | |
| 2006/0046835 | A1 | 3/2006 | Walker et al. | |
| 2006/0068876 | A1 | 3/2006 | Kane et al. | |
| 2006/0082056 | A1 | 4/2006 | Kane et al. | |
| 2006/0172794 | A1 | 8/2006 | Walker et al. | |
| 2006/0172799 | A1 | 8/2006 | Kane et al. | |
| 2006/0211471 | A1 | 9/2006 | Walker et al. | |

OTHER PUBLICATIONS

"Lady Luck Casino Hotel Players on 'Best Value' Win Streak", PR Newswire, Apr. 25, 1995, Section: Financial News. 1 pg.

"Lottery Not Such a Good Bet, Some States Finding Washington Ticket Sales Remain Steady, But 'Jackpot Fatigue' is Taking Its Toll", The Seattle Post-Intelligencer, Sep. 10, 2001, Section: News, p. B4. 2 pgs.

"Lottery officials say winners don't always claim prizes", The Associated Press, Mar. 4, 2002, Section: State and Regional. 2 pgs.

Company Information and Investment Highlights, "Scientific Games Corporation Leading the World in Lottery and Pari-Mutuel Technology, AMEX : SGM", Oct. 23, 2001. 2 pgs.

Flyer: "Play Super Slots, Win up to $10,000", 2 pp., undated.

Halbfinger, David M. and Golden, Daniel, "Many are cashing in on the state's coupons; Lax security and a flood of free plays are encouraging abuse by agents, players and the gaming agency itself", The Boston Globe, Apr. 10, 1997, Section: Metro/Region; p. A1. 5 pgs.

Rose, Nelson, "Is it Bingo, Or A Slot Machine?", Gambling and the Law, Gaming Studies Research Center-I, Whittier Law School, Copyright 2002, (http //gaming unlv edu/research/reading/Rose82 html). 3 pgs.

Website: "Australia's scratch ticket history", (http // www scottware com au/tickets/ausinfo htm), download date: Oct. 3, 1999. 2 pgs.

Website: "Global ePoint, Inc.—The On-Line Instant Ticket", (http //www globalepoint com/lottery htm), Copyright 2001. 2 pgs.

Website: "Jar Tickets—Jar-O'-Do, Universal Manufacturing Company, Kansas City, Missouri, U.S.A.", (http //www jarodo com/products/pjar stm), Copyright 2001. 2 pgs.

Website: "Lotology Interview Series", (http scottware com au/tickets/intl htm), download date: Aug. 10, 2002. 2 pgs.

Website: "Lottery Insider—Pulltabs", (http //www lotteryinsider com/products/pulltabs htm), download date: Dec. 11, 2003. 8 pgs.

Website: "Lucky Tab II Audio-Video Pull-Tab Dispenser Quick Review", (http //www wgtc net/pages/LuckyTabReview html), Copyright 2001. 2 pgs.

Website: "Nebraska Lottery—Nebraska lottery sales pass $500 million", (http //www nelottery com/news/500million html), Jun. 1, 2000. 2 pgs.

Website: "Nebraska Lottery—What we mean by overall odds", (http //www nelottery com/scratch/sodds htm), download date: Nov. 4, 1999. 1 pg.

Website: "The Printers Shoppe", (http //www theprintersshop com/novelties html), download date: Dec. 4, 2000. 2 pgs.

Website: "Video pull tab machines, tournaments—Rod N Reel", (http www rodnreelinc com/pulltabs htm), download date: Dec. 11, 2003. 1 pgs.

Website: "Welcome to Discovery Packaging Inc.", (http //www discoverypackaging com/Main htm), download date: Feb. 2002. 2 pgs.

Website: "Wheel of Fortune 2002 Calendar", (http shop store yahoo com/spestore/wheeloffor20.html), download date: download date: Jul. 3, 2003. 1 pg.

500

| SLOT MOVIE IDENTIFIER 502 | GAME(S) 504 | NUMBER OF OUTCOMES 506 | NUMBER OF LINES 508 |
|---|---|---|---|
| S-12345 | AROUND THE TRACK (5-REEL VIDEO) | 1500 | 5 |
| S-23456 | CHASE THE JACKPOT (5-REEL VIDEO) | 900 | 9 |
| S-78901 | JACKPOT FRENZY (3-REEL SPINNER) | 1200 | 3 |
| S-45678 | VIDEO POKER (5-8 VIDEO POKER) | 1500 | 1 |

500 (CONT.)

| BET PER LINE 510 | PRICE 512 | ADDITIONAL CONDITIONS 514 |
|---|---|---|
| $0.10 | $10.00 | BONUS ROUND SELECTIONS MADE AT RANDOM |
| $0.05 | $10.00 | -- |
| $0.10 | $20.00 | REQUIRES PLAYER SSN DUE TO HIGH POSSIBLE JACKPOT |
| $0.25 | $20.00 | GAME PLAYS PERFECT EXPECTED VALUE STRATEGY |

FIG. 5

600

| | PLAYER IDENTIFIER 602 | SLOT MOVIE IDENTIFIER 604 | STATUS 606 | PAYOUT RECEIPT IDENTIFIER 608 | DELIVERY INSTRUCTIONS 610 | GROSS PAYOUT 612 |
|---|---|---|---|---|---|---|
| R-601 | P-073210 | S-12345-90113250 | PURCHASED | PR-1111 | MAIL TO HOME ADDRESS | N/A |
| R-603 | P-913246 | S-12345-70412619 | OUTCOMES GENERATED | PR-2222 | MAIL TO HOME ADDRESS | $0.00 |
| R-605 | P-032219 | S-78901-53210611 | OUTCOMES TRANSMITTED | PR-3333 | E-MAIL LINK TO WORK E-MAIL | ($32.00) |
| R-607 | P-035410 | S-91324-92460010 | REDEEMED | PR-4444 | E-MAIL FILE TO HOME E-MAIL | $100.00 |

FIG. 6

700

| SLOT MOVIE INSTANCE IDENTIFIER 702 | STATUS 704 | PLAYER IDENTIFIER 706 | DELIVERY INSTRUCTIONS 708 | CASINO PROPERTY 710 |
|---|---|---|---|---|
| S-12345-00132451 | OUTCOMES RECEIVED | P-631101 | PENDING | C-248102 |
| S-78901-53210611 | OUTCOMES RECEIVED | P-032219 | E-MAIL LINK TO 'TOM@SDC.COM' | C-134581 |
| S-91324-92460010 | IN PROCESS | P-835410 | E-MAIL LINK TO 'BOB@AOL.COM' | C-911324 |
| S-42104-81108321 | CREATED AND MAILED | P-042102 | MAIL TO 3 MAIN ST., BIG CITY, NY USA | C-003210 |

FIG. 7

800

| TIME 802 | OUTCOME INDICIA 804 | OUTCOME PAYOUT 806 | MODE 808 | ATTENDANT IDENTIFIER 810 | PLAYER IDENTIFIER 812 | SLOT MOVIE INSTANCE IDENTIFIER 814 |
|---|---|---|---|---|---|---|
| 1/12/2005 3:22 PM | CH-CH-CH | $2.00 | NORMAL | -- | -- | -- |
| 1/12/2005 11:22 PM | CH-BAR-CH | $0.00 | SLOT MOVIE | A-32-101 | -- | S-91234-9011420 |
| 1/12/2005 11:22 PM | OR-CH-BAR | $0.00 | SLOT MOVIE | A-32-100 | -- | S-91234-9011420 |
| 1/12/2005 11:22 PM | OR-OR-OR | $2.50 | SLOT MOVIE | A-32-100 | -- | S-91234-9011420 |

FIG. 8

METHODS AND APPARATUS FOR FACILITATING REMOTE VIEWING OF GAMING OUTCOMES

CROSS REFERENCE TO RELATED APPLICATIONS

This application claims benefit of U.S. Provisional Application Ser. No. 60/644,184 filed Jan. 14, 2005 and is also a continuation in part of co-pending U.S. Application Ser. No. 10/885,570 entitled "METHODS ANT) SYSTEMS FOR PROVIDING PAPER BASED OUTCOMES" filed Jul. 6, 2004.

The entirety of each of the above-identified applications is incorporated by reference herein for all purposes.

BRIEF DESCRIPTION OF THE DRAWINGS

FIG. 5 is a table illustrating an exemplary data structure of an available slot movies database, consistent with at least one embodiment of the present invention.

FIG. 6 is a table illustrating an exemplary data structure of a purchased slot movies database, consistent with at least one embodiment of the present invention.

FIG. 7 is a table illustrating an exemplary data structure of a movie slots status database, consistent with at least one embodiment of the present invention.

FIG. 8 is a table illustrating an exemplary data structure of an outcomes database, consistent with at least one embodiment of the present invention.

FIG. 13 illustrates an example of a screen a player viewing a DVD of outcomes previously generated by a gaming device may be presented with.

FIG. 14 illustrates an example of a screen a player viewing a DVD of outcomes previously generated by a gaming device may be presented with.

DETAILED DESCRIPTION OF PREFERRED EMBODIMENTS

1. Introduction

Figure 1:
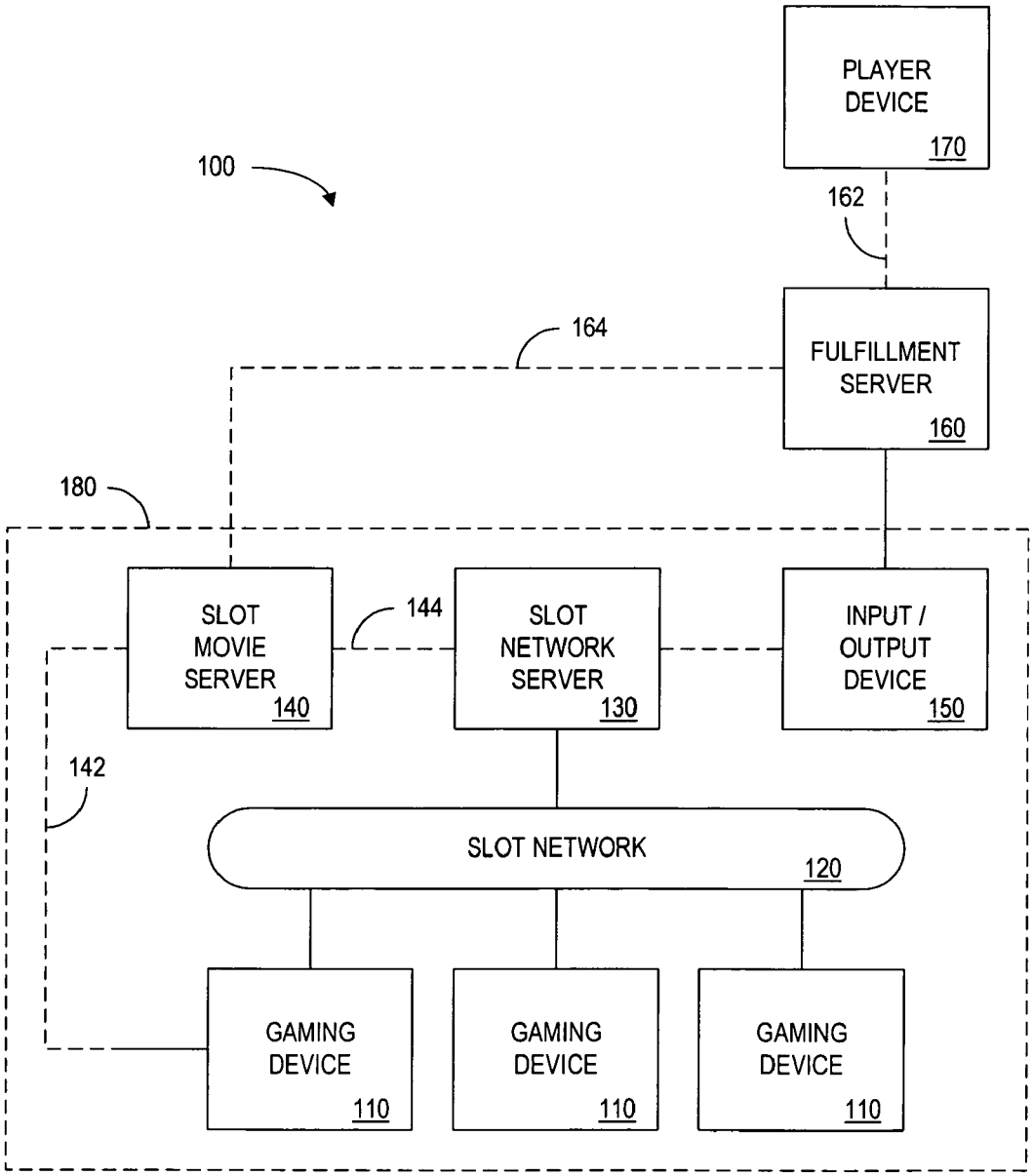
FIG. 1 is a block diagram of an example system consistent with at least one embodiment of the present invention.

Various embodiments of the present invention are directed to facilitating the experience of playing a gaming device (e.g., a slot machine). More specifically, various embodiments of the present invention are directed to facilitating the viewing of outcomes of a gaming device at a location remote from the gaming device and at a time of a player's choosing.

Various embodiments of the present invention provide a method and apparatus for usage of a gaming device which permits a casino to recognize substantially increased play time, and hence revenue, from the gaming device. At the same time, these various embodiments satisfy a player's emotional desire to maximize his playing time on a gaming device or devices, while accommodating the need to at times be away from the gaming devices and/or jurisdictions in which the gaming devices are located.

For example, to illustrate one or more embodiments of the present invention, a player may purchase a plurality of outcomes to be generated at a gaming device, the plurality of outcomes to be generated on behalf of the player. The player may provide a lump sum payment (e.g., $10.00) for the plurality of outcomes to be generated. The outcomes may be generated, for example, on behalf of the player by a gaming device operated by a casino attendant. The player may then be provided with a means of viewing the outcomes at a location other than the gaming device and at a time subsequent to a time at which the outcomes were generated. For example, the player may be provided with a tangible medium (e.g., a digital video disc (DVD)) that stores data representative of the generated outcomes or may be provided access to a Web site via which the generated outcomes are viewable. In one embodiment, the player may be mailed a DVD that has stored thereon a "movie" of the outcomes generated on behalf of the player, which the player may view at one of various available speeds. The outcomes displayed in the movie may be recreated from data indicative of the outcomes generated by a gaming device in a casino. The player may then be allowed to collect any net payout for the plurality of outcomes.

One benefit of embodiments of the present invention is an ability to allow a player to view gambling activity in any jurisdiction (e.g., even one that does not allow gambling). Such a benefit may be realized by enabling a player to purchase one or more outcomes of a gaming device (and have the outcomes generated) in a jurisdiction that does allow gambling, while subsequently viewing the outcomes and collecting a net payout for the outcomes from any jurisdiction.

Thus, for example, a player leaving Las Vegas at the end of a vacation may purchase 1,000 outcomes from his favorite slot machine and provide payment for the outcomes while in Las Vegas. The outcomes may then be generated at a Las Vegas location and a DVD of the outcomes may be mailed to the player's home, even if that home is in a jurisdiction in which gambling is not legal. Thus, the player may enjoy the slot machine experience at home by viewing the outcomes on the DVD and collecting any net payout associated therewith.

A method according to an embodiment of the present invention provides for generating a plurality of outcomes and facilitating a creation of a digital file, wherein the digital file comprises a video, the video being a sequential display of the plurality of outcomes. The method may include recreating the outcomes previously generated by a gaming device based on data indicative of the outcomes, the data having been output by the gaming device.

Various embodiments of the present invention include a gaming device operable to receive an instruction defining a first plurality of outcomes and generate the first plurality of outcomes in accordance with the instruction. The gaming device may be operable to generate the plurality of outcomes by generating a first outcome in response to receiving the instruction and then generating a second outcome without requiring any further input. In one embodiment, receiving the instruction may comprise receiving the instruction from a casino attendant. In one embodiment, an identifier that identifies the casino attendant may also be received.

In one embodiment, the first plurality of outcomes is generated on behalf of a player. Accordingly, in one embodiment the first plurality of outcomes is associated with a player identifier that identifies the player on behalf of whom the first plurality of outcomes is generated. The player may be provided with a net positive payout corresponding to the plurality of outcomes (e.g., the sum of payouts for each of the outcomes less the price, if any, that the player paid for the plurality of outcomes).

In one or more embodiments, the gaming device is further operable to determine a payout corresponding to at least one of the outcomes and store an indication of the payout. The payout may be stored to facilitate provision of the payout to a player on behalf of whom the outcome corresponding to the payout is generated.

In one embodiment, a player provides a payment of a flat fee for the plurality of outcomes, receives any net positive payout corresponding to the plurality of outcomes, but is not responsible for any losses or net negative payout corresponding to the plurality of outcomes.

In one or more embodiments, the gaming device may further be operable to generate the first plurality of outcomes at a speed that is greater than a speed at which the gaming device generates outcomes in response to initiation, at the gaming device, of game plays by a player in a conventional manner. For example, the gaming device may be operable to generate the first plurality of outcomes simultaneously or substantially simultaneously.

In one or more embodiments, the gaming device may further be operable to generate the outcomes without displaying the outcomes.

In one or more embodiments, the gaming device may further be operable to provide an indication of the generated first plurality of outcomes, wherein the indication comprises data that represents at least a sum of any payouts corresponding to the plurality of outcomes. The data may be in the form of a machine-readable bar code, such as a high-density bar code or a 2-D bar code.

In one embodiment, the indication may comprise data readable by another device, the data enabling the other device to generate a video representation of a second plurality of outcomes, wherein a sum of payouts corresponding to the second plurality of outcomes equals the sum of payouts corresponding to the first plurality of outcomes. In one embodiment, each of the outcomes of the first plurality of outcomes is a respective outcome of the second plurality of outcomes.

Various embodiments of the present invention include a device operable to receive data representative of a plurality of outcomes previously generated by another device and translate the data into a video representation of the outcomes, the video representation comprising a sequential output of the plurality of outcomes.

Various embodiments of the present invention include a system that includes a first device operable to receive an instruction defining a first plurality of pseudo-random outcomes, generate the first plurality of pseudo-random outcomes in accordance with the instruction, and output an indication of the first plurality of pseudo-random outcomes, wherein the first plurality of pseudo-random outcomes is in encoded and machine-readable form. In one embodiment, the first plurality of outcomes may be in a human-readable form. In one embodiment, the system further includes a second device operable to receive the indication and transmit the indication to a third device. In one embodiment, the system further includes a third device operable to receive the indication, decode the indication to determine a second plurality of outcomes corresponding to the indication, and create a video representation of the second plurality of outcomes. In one embodiment, the third device is further operable to store the video representation on a tangible medium and cause the tangible medium to be provided to a player associated with the first plurality of pseudo-random outcomes.

Various embodiments of the present invention include a recorder device operable to interface with a processor of a gaming device, the recorder device operable to capture an indication of outcomes generated by the gaming device but not displayed by the gaming device. In one embodiment, the outcomes are displayed by the gaming device and the recorder comprises a camera operable to capture the displayed outcomes. In one embodiment, such a camera need not be operable to interface with the processor of the gaming device.

A method of the present invention provides for generating a plurality of pseudo random outcomes at a first location, facilitating a video to be created, the video being of a sequential output of the plurality of pseudo-random outcomes, and facilitating a provision of the video to a player for viewing of the video at a second location that is different from the first location.

Described below, in the following order, are (i) various terms and concepts that apply to the present description, (ii) drawings illustrating example devices and system configurations that may be used to implement one or more embodiments of the present invention, (iii) drawings illustrating example tables that may be used to implement one or more embodiments of the present invention, (iv) drawings illustrating example processes, algorithms, programs and/or subroutines that may be used to implement one or more embodiments of the present invention, and (v) drawings illustrating example screens that may be output to a player viewing a slot movie in accordance with embodiments of the present invention.

2. General Terms and Concepts

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein.

Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

It will be readily apparent that the various methods and algorithms described herein may be implemented by, e.g., appropriately programmed general purpose computers and computing devices. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing instructions that may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable-media may be involved in carrying a sequence of instructions to a processor.

Various embodiments of the present invention are described herein with reference to the accompanying drawings. The leftmost digit(s) of a reference numeral typically identifies the Figure in which the reference numeral first appears.

As will be understood by those skilled in the art, the drawings illustrating exemplary data structures and accompanying descriptions presented herein are exemplary arrangements for stored representations of information. A number of other arrangements may be employed besides the tables shown. Similarly, the illustrated entries represent exemplary information, but those skilled in the art will understand that the number and content of the entries can be different from those illustrated herein.

The term "slot movie session" as used herein and unless specified otherwise, refers to a plurality of outcomes that a player tenders consideration for (e.g., in the form of one payment (e.g., a flat rate payment of $10.00 for 1,000 outcomes)) and/or for which plurality of outcomes the player may realize a benefit. In one or more embodiments, the plurality of outcomes may subsequently be generated on behalf of the player (e.g., by a casino attendant operating a gaming device). In one embodiment, outcomes may be generated for a slot movie in accordance with parameter values defining a slot movie session before a player purchases the slot movie session. For example, in one embodiment a casino or other entity may sell pre-packaged slot movies (e.g., in the form of DVDs) at a casino counter or gift shop.

A slot movie session may be defined by one or more parameters, each parameter corresponding to one or more values. For example, a slot movie session may be defined by (i) a game, (ii) a number of outcomes or duration of play and (iii) a price. Other examples of parameters that may define a slot movie session, without limitation, include (i) a starting credit meter balance, (ii) a threshold above which winnings can be collected; (iii) active payout combinations; (iv) wager per game play (whether average or actual per individual game play). Thus, for example, a player may purchase a slot movie session comprising 1,000 outcomes at a "Triple Gems" slot machine game for $20.00. In one or more embodiments, a player may be allowed to customize one or more parameter values defining a slot movie session, thus customizing the slot movie session. For example, the player may be allowed to specify a particular gaming device at which the outcomes are to be generated and/or to specify how one or more decisions that may be required during game play (e.g., during a bonus round) are to be executed.

The term "slot movie" as used herein and unless specified otherwise, refers to a video representation of a plurality of outcomes generated on a gaming device. A slot movie is a video representation irrespective of whether it has been fixed in a tangible medium to be provided to a player (e.g., a DVD). As described, in one embodiment a video representation of the outcomes may be provided to the player for viewing at a time and/or location of the player's choosing. In one embodiment, a slot movie may comprise a re-creation of outcomes generated by a slot machine, the re-creation being based on data indicating the outcomes generated on the slot machine. A slot movie may be provided to a player via a variety of mediums, such as via a DVD, CD-ROM, floppy-disk, flash-memory chip, Web site, or dedicated cable channel. A slot movie may be created in response to a player's purchase of a slot movie session or may be created before any purchase by a player and be made available for purchase after creation.

In one embodiment, a video representation comprises a depiction of the actual outcomes being generated at a gaming device (e.g., in real time or after a time delay) and is thus not a re-creation of the outcomes. For example, a digital camera (e.g., video or still camera) may be operable to capture outcomes displayed on a gaming device, the gaming device operating in accordance with one or more embodiments of the present invention. Slot movie server 140, fulfillment server 160 or another server, may be operable to transmit the captured images over a network, such as over the Internet.

The term "outcome", unless specified otherwise, refers to a result of a game play on a gaming device or another device operable to generate pseudo-random results. The outcome may correspond to a payout (e.g., an amount of money, credits, comp points or other value) and/or one or more game indicia or set of game indicia that represents the outcome. For example, a payout of $1.00 and the set of game indicia of "cherry-cherry-cherry" may correspond to an outcome of a game play on a three-reel slot machine.

It should be noted that a game play may include a resolution of game indicia among more than one payline (for example, a reeled slot machine may include three paylines). For example, the resolution of game indicia for a game play of a three-payline slot machine may comprise: (i) cherry-cherry-bar along first payline, (ii) bar-seven-orange along a second payline, and (iii) cherry-bar-orange along a third payline. In one embodiment, the resolution of game indicia on each of the plurality of paylines for the game play may comprise a single outcome. In such an embodiment, the payout corresponding to the outcome may comprise a sum of the payouts corresponding to the game indicia along each of the three paylines. In another embodiment, the set of game indicia along each individual payline may comprise an individual outcome. Thus, in the above example, the "cherry-cherry-bar" set of game indicia along the first payline would comprise a first outcome, the "bar-seven-orange" along the second payline would comprise a second outcome, and the "cherry-bar-orange" along the third payline would comprise a third outcome. In this latter embodiment, the payout corresponding to the game indicia along each individual payline may comprise the payout corresponding to each respective outcome for the payline.

The term "casino", unless otherwise specified, refers to the owner of gaming devices, owners' agents, and/or any entity who may profit from players' use of the gaming devices.

The term "casino location", unless otherwise specified, refers to the physical geographic site, complex, or building where gaming devices owned and/or operated by a casino are located. In the case of an online casino, casino location may refer to the address (e.g, the uniform resource locator (URL)) of the online casino's Web site or facility. In another example, the casino location may be the location where servers that facilitate embodiments of the present invention are located and/or monitored.

The term "server", unless otherwise specified, may refer to any device that may communicate with one or more gaming devices, one or more third-party servers, one or more remote controllers, one or more player devices, and/or other network nodes, and may be capable of relaying communications to and from each.

The terms "player device" and "user device" shall be synonymous and may refer to any device owned or used by a user or consumer capable of accessing and/or displaying online and/or offline content. Player devices may communicate with one or more casino servers, one or more gaming devices, one or more third-party service provider servers, one or more user terminals, and/or other network nodes. In some embodiments, a player device may read data from a tangible media, such as a CD-ROM, DVD or cashless gaming ticket. In some embodiments, player devices may, for example, include DVD players, televisions, gaming devices, personal computers, personal digital assistants, point-of-sale terminals, point of display terminals, kiosks, telephones, cellular phones, automated teller machines (ATMs), pagers, and combinations of such devices.

The term "input device", unless otherwise specified, refers to a device that is used to receive an input. An input device may communicate with or be part of another device (e.g. a point of sale terminal, a point of display terminal, a user terminal, a server, a player include: a bar-code scanner, a scanner, a magnetic stripe reader, a computer keyboard, a point-of-sale terminal keypad, a touch-screen, a microphone, an infrared sensor, a sonic ranger, a computer port, a video camera, a motion detector, a digital camera, a network card, a universal serial bus (USB) port, a GPS receiver, a radio frequency identification (RFID) receiver, a RF receiver, a thermometer, a pressure sensor, and a weight scale.

The term "output device", unless otherwise specified, refers to a device that is used to output information. An output device may communicate with or be part of another device (e.g., a television, a PC disply, a gaming device, a point of sale terminal, a point of display terminal, a player device, a casino device, a controller, etc.). Possible output devices include: a communication port via which signals to another device may be sent, a cathode ray tube (CRT) monitor, liquid crystal display (LCD) screen, light emitting diode (LED) screen, a printer, an audio speaker, an infra-red transmitter, a radio transmitter.

The term "I/O device" may refer to any combination of input and/or output devices.

3. Devices/Systems

Referring now to FIG. 1, illustrated therein is a block diagram of one example system 100 that may be used to implement one or more embodiments of the present invention. It should be noted that not all of the devices illustrated in system 100 may be operable to directly communicate with one another. As will be described below, in some embodiments it may be preferred that some devices of the system 100 are in fact not operable to communicate with one another.

System 100 includes a plurality of gaming devices 110, a slot network 120, a slot network server 130, a slot movie server 140, an input/output device 150, a fulfillment server 160 and at least one player device 170. It should be noted that although only three gaming devices 110 are illustrated, any number of gaming devices 110 may be used. Similarly, it should be noted that although only one player device 170 is illustrated, any number of player devices 170 may be used. Further, it should be noted that any and all of the slot network server 130, the slot movie server 140 and the fulfillment server 160 may comprise a plurality of servers operable to work in a cooperative manner to carry out processes consistent with one or more embodiments described herein. Further still, any of the processes described herein as being performed by a particular device (e.g., slot movie server 140) may instead or in addition be partly or wholly performed by another device (e.g., fulfillment server 160). Similarly, any data described herein as being stored in a memory of a particular device (e.g., slot movie server 140) may instead or in addition be partly or wholly stored on another device (e.g., slot network server 130).

Each of the devices may comprise one or more computers, such as those based on the Intel™ Pentium™ processor. The one or more computers may be programmed to perform processes, subroutines and/or calculations in accordance with embodiments of the present invention.

One or more of the gaming devices 110 may be implemented as a system controller, a dedicated hardware circuit, an appropriately programmed general-purpose computer, or any other equivalent electronic, mechanical or electromechanical device. A gaming device 110 may comprise, for example, a slot machine (e.g., mechanical, electromechanical, or video-based), a video poker machine, a video blackjack machine, a video keno machine, a video lottery machine, a pachinko machine or a table-top game. In various embodiments, a gaming device may comprise, for example, a personal computer (e.g., which communicates with an online casino Web site), a telephone (e.g., to communicate with an automated sports book that provides gaming services), or a portable handheld gaming device (e.g., a PDA). A gaming device 110 may comprise any or all of the gaming devices of the aforementioned systems. In some embodiments, a user device such as a PDA or cell phone may be used in place of, or in addition to, some or all of the gaming device components. Further, a gaming device 110 may comprise a personal computer or other device operable to communicate with an online casino and facilitate game play at the online casino. In one or more embodiments, the gaming device may comprise a computing device operable to execute software that simulates play of a reeled slot machine game, video poker game, video blackjack game, video keno game, video roulette game, or lottery game.

It should be noted that the system 100 may include a variety of different types of gaming devices. For example, one gaming device 110 in communication with network server 130 may comprise a multi-reel slot machine (e.g., mechanical, electromechanical, or video-based) while another gaming device 110 may comprise a video poker device.

In embodiments in which the devices of system 100 communicate with one another, it should be understood that communication among any combination of the devices may be direct or indirect. For example, communication among any and all of the devices of system 100 may be via a wired or wireless medium such as the Internet (e.g., through a Web site maintained by computer on a remote server or over an online data network including commercial online service providers, bulletin board systems and the like), LAN, WAN or Ethernet, Token Ring, or via any appropriate communications means or combination of communications means. In yet other embodiments, communication among any combination of the devices may be over RF, cable TV, satellite links and the like.

Some, but not all, possible communication networks that may comprise the slot network 120, any other network described herein, or be otherwise part of the system 100 include: a local area network (LAN), a wide area network (WAN), the Internet, a telephone line, a cable line, a radio channel, an optical communications line, and a satellite communications link. A variety of communications protocols may be part of the system, including but not limited to: Ethernet (or IEEE 802.3), SAP, SAS™, SuperSAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Any and all communication among any of the devices of system 100 may be encrypted to ensure privacy and prevent fraud in any of a variety of ways well known in the art.

The slot network server 130 may comprise one or more server computers operable to transmit data to and receive data from one or more gaming devices 110. For example, slot network server 130 may be operable to determine and/or store gaming activity associated with one or more of the gaming devices 110 (e.g., coin-in, coin-out, hopper empty, outcomes generated, data associated with an outcome generated at a gaming device, a status of a gaming device, data associated with a player playing a gaming device (e.g., based on the player identifier inserted into the player tracking module of the gaming device), etc.). In one embodiment, the slot network server 130 may be operable to time/date stamp an outcome (e.g., store an indication of a time and date that an outcome was generated).

In another example, the slot network server 130 may be operable to monitor activity at a gaming device 110 to determine whether one or more qualifying events has occurred at the gaming device or a status of the gaming device is a status that satisfies one or more predetermined conditions. For example, in one embodiment a gaming device 110 may be used to generate outcomes for a slot movie during times when the gaming device is not being used, has not been used for a predetermined period of time, and/or during times at which nearby gaming devices are not being used or have not been in use for a predetermined period of time. Accordingly, the slot network server 130 may be operable to monitor an activity status of one or more gaming devices 110.

It should be understood that any communication among the slot network server 130 and a gaming device 110 may be initiated by the slot network server 130 and/or by the gaming device 110. For example, in one embodiment the slot network server 130 may be programmed to poll or query a gaming device 110 (e.g., at periodic intervals and/or in response to an occurrence of one or more events). In another example, a gaming device 110 may be programmed to transmit data to slot network server (e.g., at periodic intervals and/or upon an occurrence of one or more events).

In one embodiment, the slot network server 130 may be operable to transmit data, signals, instructions and/or other information to one or more of the gaming devices 110. For example, in one embodiment the slot network server 130 may be operable to direct a gaming device 110 to generate one or more outcomes for a slot movie (e.g., on behalf of a player who purchased a slot movie session or for a pre-packaged and as yet unsold slot movie) or to perform another activity. In another example, the slot network server 130 may be operable to generate and transmit, to a gaming device 110, one or more random numbers for use in determining outcomes at the gaming device.

The slot movie server 140 may comprise one or more servers operable to store information about slot movie sessions available for purchase or otherwise available for provision to a player. The slot movies server 140 may further be operable to store information about slot movies purchased and or otherwise provided to a player. For example, slot movie server 140 may be operable to store information about a price and one or more other parameters that define a slot movie available through the system 100. Example information regarding a slot movie session that may be stored by a slot movie server 140 is discussed in more detail with respect to the available slot movie sessions database 500 (FIG. 5) and the purchased slot movie sessions database 600 (FIG. 6). In one embodiment, the slot movies server 140 may be operable to store information about one or more slot movies created and available for sale.

Information stored by the slot movie server 140 may be available to a player via casino personnel and/or via one or more devices. For example, in one embodiment, casino personnel may access the information stored on the slot movie server 140 via a computer at a service counter of the casino or via a handheld device. The casino personnel may then provide the information to the player (e.g., by allowing the player to view the information via an output device such as a display screen of the slot movie server 140 or another device in communication with the slot movie server 140). For example, in one embodiment some or all of the information stored by the slot movie server 140 may be viewable via a menu of available slot movie sessions. The menu may be available for output to a player (e.g., via a display device of the slot network server 140, a display device of another device operable to communicate with slot network server 140, by being printed on a substrate such as paper, etc.). In one embodiment, a casino hotel guest may view and/or hear about the available slot movie sessions via a television in a casino hotel room (e.g., the television may have access to the information stored on the slot movie server 140).

In one embodiment, a player may access information about available slot movies and/or about available slot movie sessions via a kiosk operable to access the available slot movies server 140. In such an embodiment, the kiosk may be operable to receive a selection of a slot movie from the player, accept payment therefore, and provide a receipt or other verification of the purchase. Similarly, in one embodiment a kiosk may be operable to receive selection of a slot movie session from a player, accept payment therefore, provide a receipt or other verification of purchase and queue, launch, instruct and/or otherwise cause the generation of outcomes for a slot movie in accordance with the purchase.

In one embodiment, a player may access information about available slot movies and/or available slot movie sessions via a gaming device 110. For example, a gaming device 110 may be operable to communicate with slot movie server 140 and thus provide such information (e.g., via a menu screen called up by input from the player). Such a gaming device may also be operable to receive a selection of a slot movie session from a player, receive payment therefore, and provide a receipt or other verification of the purchase. The gaming device may or may not be the gaming device which is to generate the outcomes for the slot movie to be created as a result of the purchase.

In one embodiment, information about one or more slot movies and/or one or more slot movies sessions may be entered into slot movie server 140 by casino personnel (e.g., casino personnel may define a new slot movie session and/or provide an indication of a purchase of a slot movie session). In another embodiment, information about one or more slot movies and/or slot movie sessions may be entered into slot movie server 140 via another device (e.g., via a kiosk, gaming device 110, slot network server 130, or another device).

In one or more embodiments, slot movie server 140 may be programmed to calculate or otherwise determine information about a slot movie and/or slot movie session based on one or more variables, algorithms, and/or instructions. For example, slot movie server 140 may be programmed to define a new slot movie session by determining values for one or more parameters that define a slot movie session. Similarly, slot movie server 140 may be programmed to update information defining an available slot movie session by updating values for one or more parameters defining the slot movie session. Examples of parameters that may define a slot movie session include: (i) a game for which outcomes are to be generated, (ii) a particular gaming device or type of gaming device on which the outcomes are to be generated, (iii) a price of the slot movie session, (iv) a number of game plays or duration of time that defines an end point of the slot movie session, (v) a wager per game play applicable to the slot movie session, (vi) active payout combinations, and/or (vii) rules for making any necessary decisions during a game play. For example, slot movie server 140 may be programmed to determine or update prices for slot movie sessions based on pricing information about games on which the slot movie session is based, based on a popularity of a slot movie session, and/or based on any net payouts due to players who purchased a slot movie session.

As indicated by dashed line 142, slot movie server may or may not be operable to communicate with one or more gaming devices 110. As indicated by dashed line 144, slot movie server 142 may or may not be operable to communicate with the slot network server 130. It should be noted that slot movie server 140 may be in communication with one or more devices not illustrated in FIG. 1 (e.g., a kiosk, a computer at a casino service desk, another casino server, etc.).

The input/output device 150 comprises a device operable to receive information indicative of outcomes generated by one or more of the gaming device 110 and to transmit the information to a fulfillment server 160. The input/output device 150 may comprise, for example, a scanner and/or bar code reader for inputting data and a communication port for transmitting data electronically to another device (e.g., the fulfillment server 160). As will be described in more detail below, the fulfillment server 160 may be operable to receive an indication of outcomes generated by a gaming device (e.g., on behalf of a player) and create a video representation of the outcomes. The video representation may then be provided to the player on whose behalf the outcomes were generated and/or made available for purchase, for viewing at a time and/or location of a player's choosing.

In one embodiment, it may be desirable for the input/output device 150 to not be operable to communicate with any of the gaming devices 110, the slot network 120, nor with the slot network server 130. This may be so to alleviate any concerns of regulatory bodies that the outcomes that are generated for slot movies may be tampered with before the representations thereof are provided to a player. Thus, in accordance with one or more embodiments, a gaming device 110 may print or otherwise output an indication of outcomes generated for a slot movie and the indication may be input to input/output device 150. Input/output device 150 may then transmit the indication (e.g., after translating it into a different form, compressing it, encrypting it, etc.) to the fulfillment server 160. For example, as will be described in more detail below, a gaming device may print on one or more papers an indication of outcomes generated on behalf of a player who purchased a slot movie. The indication may be in the form of one or more bar codes (e.g., one or more bar codes may represent one or more outcomes). The paper with the bar code printed thereon may be physically transported from the gaming device to the input/output device 150 by casino personnel, who may then scan the one or more bar codes or otherwise scan or input the information on the paper (or at least a portion thereof) to the input/output device 150). The paper may be saved in a file kept by the casino, for future authentication, verification, or auditing purposes.

It should be noted that the information output by a gaming device that indicates the one or more outcomes generated by the gaming device in accordance with a slot movie session may be in any machine-readable form. For example, a high-density bar code or two-dimensional (2-D) bar code may be printed. Two dimensional bar coding is described in detail in the publication entitled "Two Dimensional Bar Coding" by Barnes et al, published Spring 1999 by Purdue University, Tech 621. The entirety of this publication is incorporated by reference herein for all purposes. Further, detailed information on the usage and creation of bar codes may be found on the Web site located at www.links999.net/hardware/barcode/ barcode glossary.html, The entirety of this information is incorporated by reference herein for all purposes.

In one embodiment, the input/output device 150 is in communication with one or more gaming devices 110, slot network 120 and/or slot network server 130. For example, in one embodiment input/output device 150 is a component of another device, such as slot network server 130 or another casino server. In such embodiments, data indicative of outcomes generated by a gaming device (e.g., on behalf of a player) may be electronically transmitted to input/output device 150, which may forward the data (in altered or unaltered form) to fulfillment server 160.

As briefly described above, fulfillment server 160 may comprise one or more servers operable to receive data indicative or representative of a plurality of outcomes generated by a gaming device (e.g., on behalf of a player) and create a video representation of the outcomes based on the received data. For example, fulfillment server 160 may be operable to receive bits representative or indicative of one or more of: (i) a plurality of outcomes generated on behalf of a player, (ii) a net payout associated with the one or more outcomes, (iii) a gross payout associated with the one or more outcomes, (iv) a payout corresponding to each outcome, (v) an identity of a player, if any, on behalf of whom the outcomes were generated, (vi) a game for which the outcomes were generated, (vii) a gaming device or type of gaming device on which the outcomes were generated, (viii) a format in which the outcomes are to be displayed in the video presentation, (ix) an address (e.g., postal mailing address) to which the video presentation or an indication thereof is to be sent, (x) format data associated with outcomes to be displayed in the video presentation, (x) a time and/or date at which an outcome was generated, and/or (xi) format information and/or preferences for viewing the outcomes. Examples of the last item include: a number of reels per screen, a time between game plays being displayed and a size of text, icons and/or indicia being displayed. The fulfillment server 160 may further be operable to translate the bits into data in another form. For example, the fulfillment server 160 may be operable to translate the bits representative of an outcome into a set of game indicia corresponding to the outcome. Various processes that the fulfillment server 160 may be operable to perform are described in more detail below.

In one embodiment, fulfillment server 160 may be operable to communicate with slot movie server 140, as indicated by dashed line 164. For example, fulfillment server 160 may receive a slot movie identifier in association with data representative or indicative of one or more outcomes generated on behalf of a player. The fulfillment server 160 may communicate with slot move server 140 to determine the parameters of the slot movie session corresponding to the slot movie identifier and/or information about the manner in which the outcomes are to be output in a video presentation (e.g., based on player and/or casino preferences).

As indicated by perimeter 180, in one embodiment the fulfillment server 160 may be located outside of a casino property or otherwise at a location different from a location at which the gaming devices 110, slot network 120, slot network 130 and slot movie server 140 are located. For example, fulfillment server 160 may be operated by or on behalf of an entity distinct from an owner or operator of a casino in which the gaming devices 110, slot network 120, slot network server 130 and slot movie server 140 is operated. In another embodiment, the same entity may own and/or operate both, the The player device 170 may comprise any device operable to display a video representation of the outcomes generated by a gaming device (e.g., on behalf of a player). For example, the player device 170 may comprise a television and DVD player (in embodiments in which the video representation is provided to the player in the form of a DVD) or a personal computer (in embodiments in which the video representation is provided to the player online vie a Web site). In one embodiment, the player device 170 may be operable to communicate with fulfillment server 160, as indicated by dashed line 162. For example, in one embodiment fulfillment server 160 may comprise a server computer that hosts a Web site via which a player using a player device comprising a personal or laptop computer, pager, telephone, personal digital assistant may view a video representation of outcomes generated by a gaming device (e.g., on behalf of the player).

In one or more embodiments, system 100 may include devices in addition to those illustrated in FIG. 1. For example, system 100 may include a kiosk (e.g., via which a slot movie may be purchased and/or via which a payout corresponding to a previously purchased slot movie may be obtained). As briefly described, in some embodiments, a kiosk may be configured to execute or assist in the execution of various processes of the present invention. In some embodiments, a kiosk may comprise a processor and a memory as described. A kiosk may also comprise various input devices (e.g., a keypad, a keyboard, a mouse, buttons, a port that receives player tracking cards, an optical scanner for reading barcodes or other indicia, a CCD camera, etc.), output devices (e.g., a display screen, audio speakers, etc.), benefit output devices (e.g., a coin tray or printer for printing cashless gaming tickets), combinations thereof (e.g., a "ticket-in/ticket-out" device, a touch-sensitive display screen, etc.), communications ports, and so on. Thus, a kiosk may comprise many of the features and components of a gaming device, though the kiosk itself may not necessarily be configured to enable gambling activity as a primary function. A kiosk may communicate with any or all of (i) a central controller, (ii) a gaming device, (iii) an inventory/reservation system of a casino-maintained property (e.g., a hotel), (iv) casino personnel devices, (v) merchant POS terminals, and so on. A number of kiosks may be stationed within casino premises (e.g., at various locations on a slot floor).

In various embodiments, kiosks may execute or assist in the execution of (i) determining and outputting a player status or other types of data described herein (e.g., a kiosk receives a player tracking card, and outputs a number of accumulated reward which a player may be entitled to redeem), (ii) outputting payments to players (e.g., upon receipt of cashless gaming tickets, player tracking cards, smart cards, etc.), and/or (iii) any other process described herein. For example, a kiosk may be configured to output available slot movies to a player (e.g., output a menu of available slot movies, the menu specifying for each movie the values of the parameters defining the slot movie). The kiosk may further be configured to accept a player's selection of a slot movie and accept payment therefore. In embodiments in which a player is allowed to customize a slot movie, the kiosk may be configured to output customization options to the player and receive the player's selections thereof. Thus, such a device may be configured to read from and/or write to one or more databases of the present invention. The memory of such a device may store a program for executing such processes.

In some embodiments, system 100 may include one or more casino personnel devices. For example, in one or more embodiments various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a casino personnel device may communicate with a gaming device 110, slot network server 130, a kiosk and/or another device (e.g., a server that operates as an inventory/reservation system of a casino-maintained property (e.g., a hotel)). Thus, a casino personnel device may be configurable to, among other things, (i) read from and/or write to one or more databases of the present invention, (ii) assist in payments made to players (e.g., a representative "scans" a cashless gaming receipt and determines a value associated with the receipt, and if the receipt is valid, provides payment equal to the value), and/or (iii) execute or assist in the execution of various other processes described herein. The memory of such a device may store a program for executing such processes.

In some embodiments, various merchants (e.g., shops, restaurants, etc.) may utilize point-of-sale (POS) computer terminals to facilitate various processes of the present invention. For example, in some embodiments, a player may receive via a merchant POS computer terminal, a voucher or other instrument entitling the player to a slot movie. In another example, a player may receive a prize redeemable at a merchant as a net payout for a slot movie previously purchased by the player. In some embodiments, such merchant POS computer terminals may be configured to read from and/or write to one or more databases of the present invention. Such POS terminals may thus comprise various hardware and software described herein with respect to other devices, and may communicate with (i) a central slot server, (ii) a gaming device, (iii) an inventory/reservation system (e.g., a computer terminal at a theatre communicates with an inventory database to determine a number of unsold seats for a certain event), (iv) a kiosk, and so on.

In some embodiments of the present invention, various component devices (e.g., any or all of the benefit output devices, output devices, input devices and/or input output devices described herein) may be embodied as peripheral devices. For example, such devices may not necessarily be components of a gaming device, though they may be configured in such a manner so as to communicate with one or more gaming device processors or any other devices described herein. For example, a peripheral device such as a large display device may be associated with a plurality of gaming devices, and thus may not necessarily be considered a component of any one gaming device. Further, in some embodiments, certain peripheral devices such as card readers may be interchangeable between gaming devices, and thus may be considered a component of a first gaming device while connected thereto, removed from the first gaming device, connected to a second gaming device, and so on. In other embodiments, various peripheral devices may never be considered a component of a particular gaming device. For example, in some embodiments, a peripheral device such as a USB-based portable memory device may store (i) one or more databases described herein, and/or (ii) a program for executing one or more process steps described herein. Such a peripheral device may then be utilized by casino personnel for upgrading/retrofitting existing gaming devices as described herein.

Figure 2:
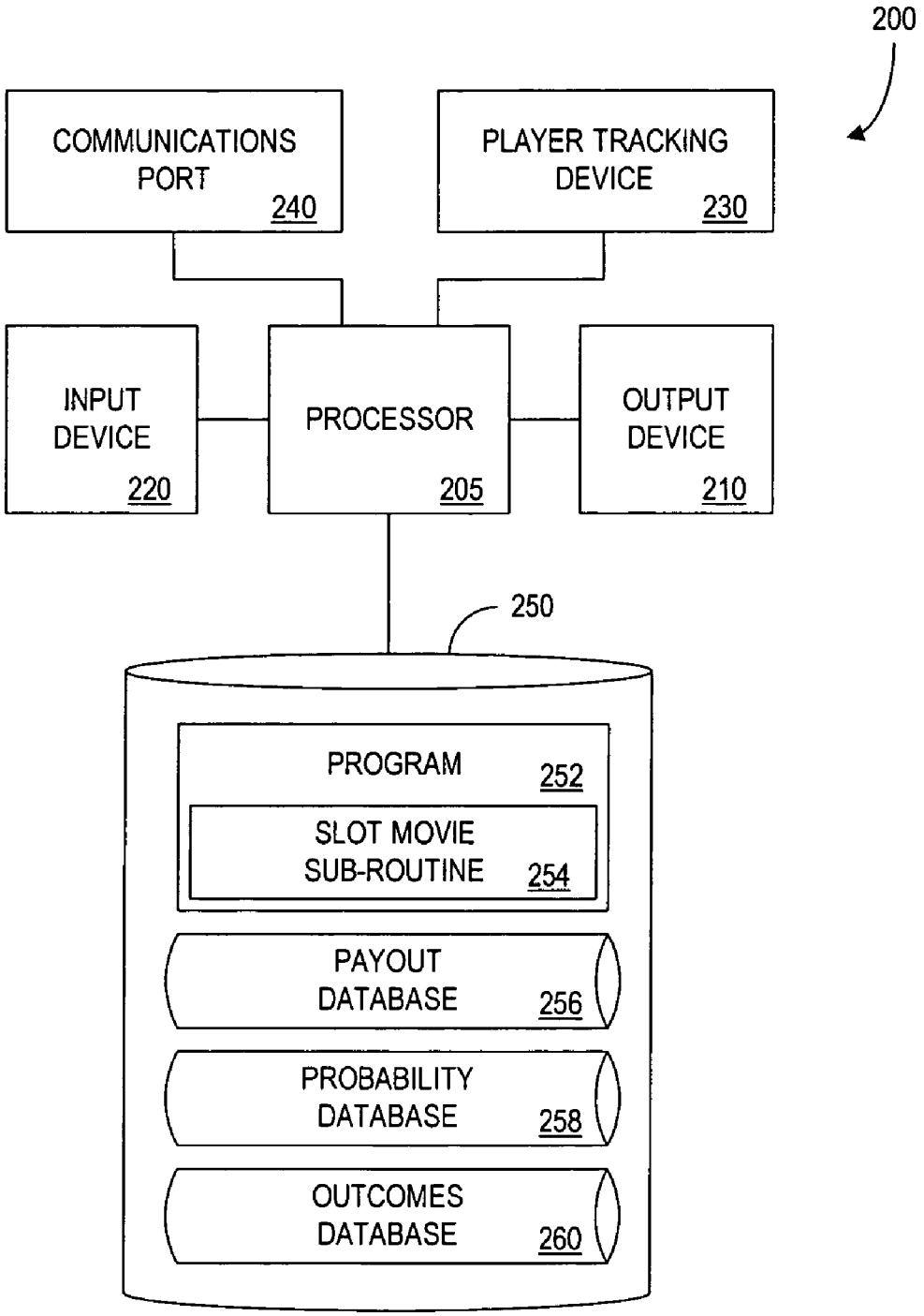
FIG. 2 is a block diagram of an example gaming device consistent with at least one embodiment of the present invention.

Referring now to FIG. 2, illustrated therein is a block diagram of an example embodiment 200 of a gaming device 110. Embodiment 200 is referred to as gaming device 200 herein. Gaming device 200 comprises a processor 205. Processor 205 is operable to communicate with a plurality of components and/or peripheral devices, including output device 210, input device 220, player tracking device 230, communication port 240, and storage device 250.

Processor 205 may comprise one or more processors, such as one or more Intel™ Pentium™ processors. For example, in one embodiment, the gaming device 200 may include two processors, one for facilitating conventional game play and one for determining outcomes on behalf of a player in accordance with one or more embodiments described herein.

The output device 210 may comprise, for example, a benefit output device. A benefit output device may comprise one or more devices for outputting a benefit to a player of the gaming device 200. For example, in one embodiment the gaming device 200 may provide coins and/or tokens as a benefit. In such an embodiment a benefit output device may comprise a hopper and hopper controller, for dispensing coins and/or tokens into a coin tray of the gaming device 200. In another example, the gaming device 200 may provide a receipt or other document on which there is printed an indication of a benefit (e.g., a cashless gaming receipt that has printed thereon a monetary value, which is redeemable for cash in the amount of the monetary value, a check cashable for monetary value). In such an embodiment a benefit output device may comprise a printing and document dispensing mechanism. In yet another example, the gaming device 200 may provide electronic credits as a benefit (which, e.g., may be subsequently converted to coins and/or tokens and dispensed from a hopper into a coin tray). In such an embodiment a benefit output device may comprise a credit meter balance and/or a processor that manages the amount of electronic credits that is indicated on a display of a credit meter balance. The processor may be the processor 205 or another processor. In yet another example, the gaming device 200 may credit a monetary amount to a financial account associated with a player as a benefit provided to a player. The financial account may be, for example, a credit card account, a debit account, a charge account, a checking account, or a casino account. In such an embodiment a benefit output device may comprise a device for communicating with a server on which the financial account is maintained.

As described, in one or more embodiments a gaming device 200 may be operable to receive an instruction (e.g., the instruction defining a number of outcomes to be generated on behalf of a player for a slot movie purchased or otherwise obtained by the player) and generate a plurality of outcomes in accordance with such an instruction. In such embodiments, the gaming device 200 may further be operable to output an indication or representation of the outcomes generated in accordance with the instruction.

For example, the gaming device 200 may be operable to print one or more receipts including one or more bar codes, each bar code representing at least one of the generated outcomes. In such an embodiment, a benefit output device may comprise a printing mechanism operable to print a receipt with such a bar code (e.g., a high density bar code) or other indication or representation. Of course, in some embodiments a bar code may represent other information, such as (i) one or more payouts, (ii) a net payout for a plurality of outcomes, (iii) a gaming device on which the outcomes were generated, (iv) a plurality of outcomes, (v) a game associated with an outcome, (vi) a time at which an outcome was generated, and/or (vii) a player and/or casino employee associated with an outcome. Further, text, indicia or information in other forms besides a bar code may represent some or all of the information described above.

In another example, the gaming device 200 may be operable to provide the indication or representation of the outcomes on a storage medium, such as a floppy disk, CD-ROM, CD, DVD, magnetic stripe card, smart card, flash memory, memory stick or other medium operable to store the indication or representation. In such an embodiment, a benefit output device may comprise a mechanism operable to encode or otherwise cause the indication or representation to be stored on the storage medium. The gaming device 200 may be operable to output such a storage medium having the indication or representation stored thereon (e.g., the gaming device may be operable to output a CD-ROM having the representation or indication encoded thereon). In another embodiment, a casino attendant may input the storage medium for the gaming device to use. In another embodiment, the gaming device 200 may output an indication or representation of the outcomes directly to a handheld device (e.g., via a USB connection).

In one or more embodiments, the printed receipt or other storage medium that includes the indication or representation of the generated outcomes may be physically transported by a casino attendant to another device (e.g., to input/output device 150). Of course, as described, in one or more embodiments the indication or representation of the outcomes generated for a slot movie may be electronically transmitted to another device.

Note that, in one or more embodiments, the gaming device 200 may include more than one benefit output device. For example, the gaming device 200 may include both a hopper and hopper controller combination and a credit meter balance. Such a gaming device may be operable to provide more than one type of benefit to a player of the gaming device. A single benefit output device may be operable to output more than one type of benefit. For example, a benefit output device may be operable to increase the balance of credits in a credit meter and communicate with a remote device in order to increase the balance of a financial account associated with a player.

In one or more embodiments, output device 210 may comprise one or more types of output devices besides or in addition to a benefit output device. For example, in some embodiments the output device 210 comprises a display device. The display device may comprise, for example, one or more display screens or areas for outputting information related to game play and/or alternate payment offers on the gaming device, such as a cathode ray tube (CRT) monitor, liquid crystal display (LCD) screen, or light emitting diode (LED) screen. In one or more embodiments, a gaming device may comprise more than one display device. For example, a gaming device may comprise an LCD display for displaying electronic reels and a display area that displays rotating mechanical reels. The display device may comprise, for example, one or more display areas. For example, one of the display areas (e.g., a primary game screen) may display outcomes of games played on the gaming device (e.g., electronic reels of a gaming device). Another of the display areas (e.g., a secondary game screen) may display rules for playing a game of the gaming device. Yet another of the display areas may display the benefits obtainable by playing a game of the gaming device (e.g., in the form of a payout table). In one or more embodiments, the output device 210 functions to output an indication of a mode that the gaming device is currently operating in. For example, if a gaming device is currently operating to generate outcomes for a slot movie, the gaming device may output an indication that it is operating in "slot movie" mode, thus informing passers-by of its unavailability for conventional game play and that any outcomes that may be being displayed via the gaming device are for a slot movie.

The processor may also be in communication with one or more other output devices besides a display device, for outputting information (e.g., to a person or another device). Such other one or more output devices may also be components of gaming device 200 or may otherwise be associated with the gaming device. Such other one or more output devices may comprise, for example, an audio speaker (e.g., for outputting an outcome or information related thereto, in addition to or in lieu of such information being output via a display device); headphones; an infra-red transmitter; a radio transmitter; an electric motor; a printer (e.g., such as for printing cashless gaming tickets); a dispenser for outputting pre-printed coupons, tickets or vouchers; an infra-red port (e.g., for communicating with a second gaming device or a portable device of a player); one or more universal serial bus (USB) ports; a Braille computer monitor; and a coin or bill dispenser. For gaming devices, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

It should be noted that, in one embodiment, a gaming device operating in "slot movie" mode (e.g., a gaming device that is currently in the process of generating outcomes for a slot movie in accordance with a received instruction) may not display the outcomes being generated or may display them in an alternate manner. For example, the gaming device may be generating the outcomes at a speed that would make it impractical to display the outcomes. Also, not displaying the outcomes may avoid confusion of passers-by (e.g., a passer-by may become confused and feel that they are due a payout if a winning outcome is displayed on the gaming device as the passer-by is within the vicinity of the gaming device). Accordingly, in one or more embodiment, a gaming device operating in "slot movie" mode may deactivate a display device that would normally display an outcome generated by the gaming device. Similarly, a gaming device operating in "slot movie" mode may utilize a subroutine for generating outcomes that is different from a subroutine used for generating outcomes in a conventional mode. For example, the subroutine utilized for generating outcomes in a conventional mode may include a step of displaying an outcome upon its generation, while the subroutine utilized for generating outcomes in "slot movie" mode may not include such a step.

The input device 220 may comprise one or more device operable to receive an input (e.g., from a player, from a casino attendant and/or from another device). Some examples of input devices include: a bar-code scanner, an optical scanner configured to read other indicia of a voucher or cashless gaming ticket, a CCD camera, a magnetic stripe reader (e.g., for reading data encoded upon a player tracking card), a smart card reader (e.g., for reading data stored upon a smart card), a computer keyboard or keypad, a button, a handle, a lever, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device or from a another device such as a smart card or PDA of a player), and a weight scale. For gaming devices, common input devices include a button or touch screen on a video poker machine, a lever or handle connected to the gaming device, a magnetic stripe reader to read a player tracking card inserted into a gaming device, a touch screen for input of player selections during game play, and a coin and bill acceptor.

In one embodiment, a casino attendant may provide an instruction to a gaming device in accordance with which the gaming device is to generate outcomes for a slot movie. Such an instruction may be input by a casino attendant using one or more input devices of the gaming device. For example, the casino attendant may utilize a touch-screen or keypad to provide such an instruction. In another example, a casino attendant may utilize a portable device or instrument for providing such an instruction. For example, a casino attendant may utilize a portable device operable to wirelessly communicate with the gaming device to provide the instruction. In another example, a casino attendant may insert or otherwise attach a portable device into a port of the gaming device to provide such an instruction. In yet another example, a casino attendant may insert a magnetic stripe card or other instrument into the gaming device to provide such an instruction. Accordingly, an input device 220 may comprise any device operable to receive such an instruction.

As described herein, in one or more embodiments a player may select a slot movie session via a menu screen of a gaming device. In such embodiments, the input device 220 may include any device operable to receive such a selection from a player. Further, as described herein, in one or more embodiments a player may be allowed to customize a slot movie session (e.g., by selecting one or more values for one or more parameters defining the slot movie session). In such embodiments, the input device 220 may comprise any device operable to receive player customization instructions.

In one embodiment, an input device may comprise a payment system. The payment system is a device capable of accepting payment from a player (e.g., a bet or initiation of a balance) and/or providing payment to a player (e.g., a payout). Payment is not limited to money, but may also include other types of consideration, including products, services, and alternate currencies. Exemplary methods of accepting payment by the payment system include (i) receiving hard currency (i.e. coins or bills), and accordingly the payment system may comprise a coin or bill acceptor; (ii) receiving an alternate currency (e.g., a paper cashless gaming ticket, a coupon, a non-negotiable token), and accordingly the payment system may comprise a bar code reader or other sensing means; (iii) receiving a payment identifier (e.g., a credit card number, a debit card number, a player tracking card number) and debiting the account identified by the payment identifier; and (iv) determining that a player has performed a value-added activity (e.g., participating in surveys, monitoring remote images for security purposes, referring friends to the casino). A payment system of a gaming device may be operable to receive payment for conventional game play and/or for a slot movie.

In some embodiments, gaming device 200 may comprise components capable of facilitating both input and output functions (i.e., input/output devices). In one example, a touch-sensitive display screen comprises an input/output device (e.g., the device outputs graphics and receives selections from players or casino personnel). In another example, processor 205 may communicate with a "ticket-in/ticket-out" device configured to dispense and receive cashless gaming tickets as is known in the art. Such a device may also assist in (e.g., provide data so as to facilitate) various accounting functions (e.g., ticket validation and redemption). For example, any or all of a gaming device, kiosk and casino personnel device maintained at a cashier cage may (i) comprise such a benefit input/output device, and/or (ii) communicate with a central server that manages the accounting associated with such ticket-in/ticket-out transactions (e.g., so as to track the issuance, redemption and expiration of such vouchers). One example of such ticket-in/ticket-out technology, the EZ Pay™ system, is manufactured by International Gaming Technology, headquartered in Reno, Nev. In one example, an instruction from a casino attendant regarding generation of outcomes for a slot movie may be input to gaming device 200 via such a ticket-in/ticket-out system. For example, the instruction may be included on a printed ticket (e.g., in machine-readable format) that the casino attendant inputs into such a device.

The player tracking device 240 may comprise any device operable to receive information associated with an identifier and/or to receive the identifier. The identifier may comprise, for example, an identifier that identifies a player, an identifier that identifies a casino attendant, or an identifier that identifies a slot movie session. In some embodiments, the player tracking device 240 may comprise a reader device for reading data from player tracking cards, other tracking cards, smart cards and/or other instruments on which data is stored. This may aid in (i) identifying players, casino attendants and/or slot movie sessions and (ii) determining various data associated with the player, casino attendant and/or slot movie session so identified. In one example, a card reader device may determine an identifier associated with a player (e.g., by reading a player tracking card comprising an encoded version of the identifier), such that the gaming device may then access data (e.g., of a player database, as described) associated with the player. In another example, a smart card reader device may determine data associated with a player directly by accessing a memory of an inserted smart card.

In some embodiments, the player tracking device 240 may be utilized for functions not heretofore associated with a player tracking mechanism. To date, player tracking mechanisms have been utilized to track information about a player playing a gaming device. However, Applicants envision that a player tracking system may be utilized for purposes of facilitating one or more embodiments described herein. For example, in addition to being operable to identify a player, a player tracking system may be configured to identify a casino attendant and/or a slot movie session. In one example, a reader device of the player tracking device 240 may be operable to read an identifier identifying a casino attendant, thus allowing the identifier to be stored in association with the outcomes generated on behalf of a player for a slot movie, in order to subsequently identify which casino attendant provided an instruction to the gaming device to generate the outcomes. In another example, a reader device of the player tracking device 240 may be operable to read an identifier identifying a slot movie session and thus allow access to a record of a slot movie sessions database (e.g., available slot movie sessions database 344 and/or purchased slot movie sessions database 346 of FIG. 3). This may aid in determining values for one or more parameters defining the slot movie for which outcomes are to be generated.

As described herein, player tracking device 240 may be operable to read information from, or write information to, a smart card. As known in the art, "smart cards" may incorporate (i) a memory, and (ii) means for accessing such a memory. For example, in one embodiment, the memory may store data related to aspects of the present invention. In one embodiment, data may be written to the smart card as a player plays one or more gaming devices (e.g., such that various data may be updated on a continuous, periodic or event-triggered bases). Accordingly, in one or more embodiments one or more devices operable to carry out various processes of the present invention (e.g., a gaming device or kiosk) may have associated therewith a smart card reader device, such that data may be read from the smart card pursuant to the execution of such processes. An example of a smart card system that may be used to implement one or more embodiments of the present invention is the s-Choice™ Smart Card Casino Management System from Smart Card Integrators, InC™.

Further, as known in the art, a gaming device may comprise a player tracking module comprising (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally@Gaming and Systems.

Of course, other non-card-based methods of identifying players, casino attendants and/or slot movie sessions are contemplated. For example, a unique identification code may be associated with the player. The player may then be identified upon entering the code. For example, the code may be stored (e.g., within a database maintained within the gaming device and/or a server) such that the player may enter the code using an input device of a gaming device, and accordingly be identified. In other embodiments, player biometrics may serve as identification means (e.g., a player is identified via a thumbprint or retinal scan). In further embodiments, a barcode of a cashless gaming ticket may encode a player identifier.

Thus, as described, various data associated with a player, casino attendant, slot movie session and/or slot movie session may be tracked and stored (e.g., in an appropriate record of a centrally-maintained database), such that it may be accessed as appropriate. Further, various statistics may be measured in association with a player, casino attendant, slot movie session and/or slot movie and similarly accessed.

Various systems for facilitating such monitoring are contemplated. For example, a two-wire system such as one offered by International Gaming Systems (IGT) may be used. Similarly, a protocol such as the IGT SAS™ or SuperSAS™ protocol may be used. The SAS™ and SuperSAS™ protocol allow for communication between gaming machines and slot accounting systems and provides a secure method of communicating all necessary data supplied by the gaming device to the online monitoring system. One aspect of the SAS™ protocol that may be beneficial in implementing aspects of the present invention is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity, as well as other activity of the gaming device, in order to determine various information (e.g., player outcomes, coin-in statistics, outcomes generated for a particular slot movie on behalf of a particular player and/or any other data deemed relevant).

The storage device 250 may comprise an appropriate combination of magnetic, optical and/or semiconductor memory, and may include, for example, Random Access Memory (RAM), Read-Only Memory (ROM), a compact disc and/or a hard disk. The storage device 250 may comprise or include any type of computer-readable medium. The processor 205 and the storage device 250 may each be, for example: (i) located entirely within a single computer or other device; or (ii) connected to each other by a remote communication medium, such as a serial port cable, telephone line or radio frequency transceiver. In one embodiment, the gaming device 200 may comprise one or more devices that are connected to a remote server computer for maintaining databases.

The storage device 250 stores a program 252 for controlling the processor 205. The processor 205 performs instructions of the program 252, and thereby operates in accordance with the present invention, and particularly in accordance with the methods described in detail herein. The program 252 may be stored in a compressed, uncompiled and/or encrypted format. The program 252 furthermore includes program elements that may be necessary, such as an operating system, a database management system and "device drivers" for allowing the processor 205 to interface with computer peripheral devices. Appropriate program elements are known to those skilled in the art, and need not be described in detail herein. The program 252 may further include one or more subroutines for carrying out methods of the present invention. For example, the program 252 may include a slot movie subroutine 254, which directs the processor 205 to determine a plurality of outcomes (e.g., on behalf of a player), in accordance with one or more instructions. The one or more instructions may comprise one or more instructions defining a slot movie (e.g., a slot movie purchased by a player). For example, the one or more instructions may comprise an instruction to determine a specific number of outcomes. The one or more instructions may be provided to the gaming device 200 via a variety of manners, as described herein. For example, a casino attendant may input a code to gaming device 200, the code recognizable by the gaming device as representative or indicative of one or more instructions for generating outcomes.

Various forms of computer readable media may be involved in carrying one or more sequences of one or more instructions to processor 205 (or any other processor of a device described herein) for execution. For example, the instructions may initially be borne on a magnetic disk of a remote computer. The remote computer can load the instructions into its dynamic memory and send the instructions over a telephone line using a modem. A modem local to a gaming device 200 can receive the data on the telephone line and use an infrared transmitter to convert the data to an infrared signal. An infrared detector can receive the data carried in the infrared signal and place the data on a system bus for processor 205. The system bus carries the data to main memory, from which processor 205 retrieves and executes the instructions. The instructions received by main memory may optionally be stored in storage device 250 either before or after execution by processor 205. In addition, instructions may be received via communication port 240 as electrical, electromagnetic or optical signals, which are exemplary forms of carrier waves that carry data streams representing various types of information. Thus, the gaming device 200 may obtain instructions in the form of a carrier wave.

According to an embodiment of the present invention, the instructions of the program 252 may be read into a main memory from another computer-readable medium, such from a ROM to RAM. Execution of sequences of the instructions in program 252 causes processor 205 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The storage device 250 also stores a plurality of databases, including a probability database 256, a payout database 258, and an outcomes database 260. Outcomes database 260 may comprise a database of all or a subset of outcomes generated by a gaming device (e.g., within a predetermined period of time). An exemplary data structure for outcomes database 260 is described below with reference to FIG. 8.

Note that, although databases 256, 258 and 260 are described as being stored in a gaming device, in other embodiments of the present invention some or all of these databases may be partially or wholly stored in another device, such as the slot network server 130. Further, some or all of the data described as being stored in the databases 256, 258 and 260 may be partially or wholly stored (in addition to or in lieu of being stored in the storage device 250 of the gaming device 200) in a memory of one or more other devices, such as one or more of the slot network server 130 and/or the slot movie server 140.

Payout database 256 may comprise a conventional payout table that includes a list of entries, where each entry pairs an outcome or game indicia combination with a corresponding payout. A gaming device may utilize the payout database to determine whether a payout should be output to a player as a result of an outcome obtained for a game. For example, after determining the outcome to output on the gaming device, the gaming device may access the payout database to determine whether the outcome for output is one of the outcomes stored as corresponding to a payout. If it is, the gaming device may provide the corresponding payout to the player.

In one embodiment, a bonus payout may be provided for one or more game indicia combinations (e.g., for the top jackpot) if the game indicia combination is obtained by a player via a slot movie purchased by the player. In such an embodiment, a second payout database (not shown) may be used in generating outcomes for a slot movie. Alternately, a conventional payout database may be used and a bonus added to a designated payout in accordance with one or more subroutines as appropriate.

Probability database 258 may comprise a conventional probability table that includes a list of entries, where each entry pairs an outcome with a range of possible random numbers. If a generated random number falls within the range corresponding to a given outcome, then the outcome is selected. A gaming device may utilize a probability database to determine, for example, what outcome corresponds to a random number generated by a random number generator and to display the determined outcome. The outcomes may comprise the three symbols to be displayed along the payline of a three-reel slot machine. Other arrangements of probability databases are possible. In one embodiment, outcomes generated for a slot movie are selected in accordance with an alternate probability table (not shown) that provides an improved probability of obtaining one or more outcomes.

The book "Winning At Slot Machines" by Jim Regan (Carol Publishing Group Edition, 1997) illustrates examples of payout and probability tables and how they may be derived. The entirety of this book is incorporated by reference herein for all purposes.

As will be understood by those skilled in the art, the schematic illustrations and accompanying descriptions of the sample databases presented herein are exemplary arrangements for stored representations of information. Any number of other arrangements may be employed besides those suggested by the tables shown. For example, even though three separate databases are illustrated as being stored in gaming device 200, the invention could be practiced effectively using one, two, four, five, or more functionally equivalent databases. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention.

The processor 205 may also be operable to communicate with a random number generator (not shown), which may be a component of gaming device 200 or may be stored in another device (e.g., slot network server 130). The random number generator, in accordance with at least one embodiment of the present invention, may generate data representing random or pseudo-random values (referred to as "random numbers" herein). The random number generator may generate a random number every predetermined unit of time (e.g., every second) or in response to an initiation of a game on the gaming device. In the former embodiment, the generated random numbers may be used as they are generated (e.g., the random number generated at substantially the time of game initiation is used for that game) and/or stored for future use.

A random number generator, as used herein, may be embodied as a processor separate from but working in cooperation with processor 205. Alternatively, a random number generator may be embodied as an algorithm, program component, or software stored in the memory of gaming device 200 and used to generate a random number.

Note that, although the generation or obtainment of a random number is described herein as involving a random number generator of a gaming device, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

Of course, as would be understood by one of ordinary skill in the art, a random number generator may be stored in a device other than a gaming device. For example, in some embodiments, a gaming device may receive random numbers and/or any other data related to the random or pseudo-random determination of an outcome from a separate device, such as a server. It should be noted that such embodiments may be advantageous in environments or jurisdictions wherein the "central determination" of outcomes is required by regulation or otherwise preferred.

In one embodiment, gaming device 200 may include a recorder device operable to communicate with the processor 205. The recorder device may comprise any device operable to record data indicative or representative of outcomes generated by the gaming device. For example, a second processor and/or a memory may operate as a recording device.

As would be understood by one of ordinary skill in the art, the gaming device 200 may comprise various combinations of any of the components and/or devices described with respect to FIG. 2. For example, in one or more embodiments, the gaming device 200 may include more than one display device, one or more other output devices, several input devices, and so on (e.g., two display screens, two audio speakers, a ticket-in/ticket-out device and several buttons).

Embodiments described herein, such as generating outcomes on behalf of a player who purchased a slot movie, may be practiced by replacing and/or augmenting one or more components (e.g., hardware and/or software components) of an existing gaming device. Thus, in one or more embodiments, the invention may be applied as a retrofit or upgrade to existing gaming devices currently available for play within various casinos.

For example, a memory (e.g., computer chip) of the gaming device may be replaced or added, the replacement or additional memory storing a program for instructing the processor of the gaming device to operate in accordance with one or more embodiments of the present invention. In another example, data output via the gaming device (e.g., graphical and/or textual data displayed on the gaming device) may be replaced or added, the replacement or additional data indicating to a player, other person or another device information relevant to one or more aspects of the present invention.

In a specific example, a gaming device may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. One form of memory commonly found gaming devices is electronically erasable programmable read-only memory or erasable programmable read-only memory (EEPROM or EPROM). Thus, in one or more embodiments of the present invention, an EEPROM storing software with instructions for carrying out aspects of the present invention (as well as instructions for carrying out other functions traditionally performed by the gaming device) may replace an EEPROM previously installed in a gaming device, such that the gaming device may be configured to operate in accordance with various processes of the present invention.

For example, "slot movie module" may be made available for purchase to various casino operators. The module, which may comprise various hardware and software (e.g., an EEPROM storing software instructions), may be installed in an existing gaming device (e.g., a video-reel slot machine, a video poker machine, etc.), such that when the module is installed, the gaming device may be operable to (i) generate outcomes for a conventional game play, or (ii) generate outcomes for a slot movie.

Accordingly, a gaming device may be configured to operate in one of two "modes" of the gaming device, and to enable the selected mode. If a "standard" mode is activated, the gaming device may be configured to operate in a manner similar to how it operated before the installation of the module (e.g., the gaming device operates in a conventional manner, such that aspects of the present invention may not be utilized). If a "slot movie" mode is activated (e.g., a casino attendant selects slot movie mode or another device directs the gaming device to operate in slot movie mode), the gaming device may then be operable to execute game play in accordance with one or more embodiments described herein.

In one example of allowing a person (e.g., a casino attendant) to select one or more modes, a touch-sensitive display screen may be configured to output a prompt asking a person to select a mode of operation. Such a prompt may be output upon occurrence to various trigger conditions (e.g., a casino attendant inserts a card identifying the casino attendant and/or a slot movie into player tracking device 240). Accordingly, a person may select a mode of operation (e.g., by pressing an appropriately labeled icon of a touch-sensitive display screen), and upon receiving the person's selection, the gaming device may be configured to operate in the selected mode.

In other embodiments, as described, a peripheral device may be useful for implementing one or more embodiments of the present invention into the operation of a conventional gaming device. For example, in order to avoid or minimize the necessity of modifying or replacing a program already stored in a memory of a conventional gaming device, an external or internal module that comprises a peripheral device may be inserted in, connected to or otherwise associated with the gaming device.

In still further embodiments, rather than configure existing gaming devices to execute aspects of the present invention by installing or connecting new hardware and/or software, software may be downloaded into an existing memory of one or more gaming devices. U.S. Pat. No. 6,805,634 to Wells et al. teaches methods for downloading data to gaming devices in such a manner. The entirety of U.S. Pat. No. 6,805,634 is incorporated by reference herein for all purposes. Thus, in some embodiments, an existing gaming device may be reprogrammed to accommodate new functionality consistent with one or more embodiments described herein without the need, or by minimizing the need, to remove and replace hardware within the gaming device.

Figure 3:
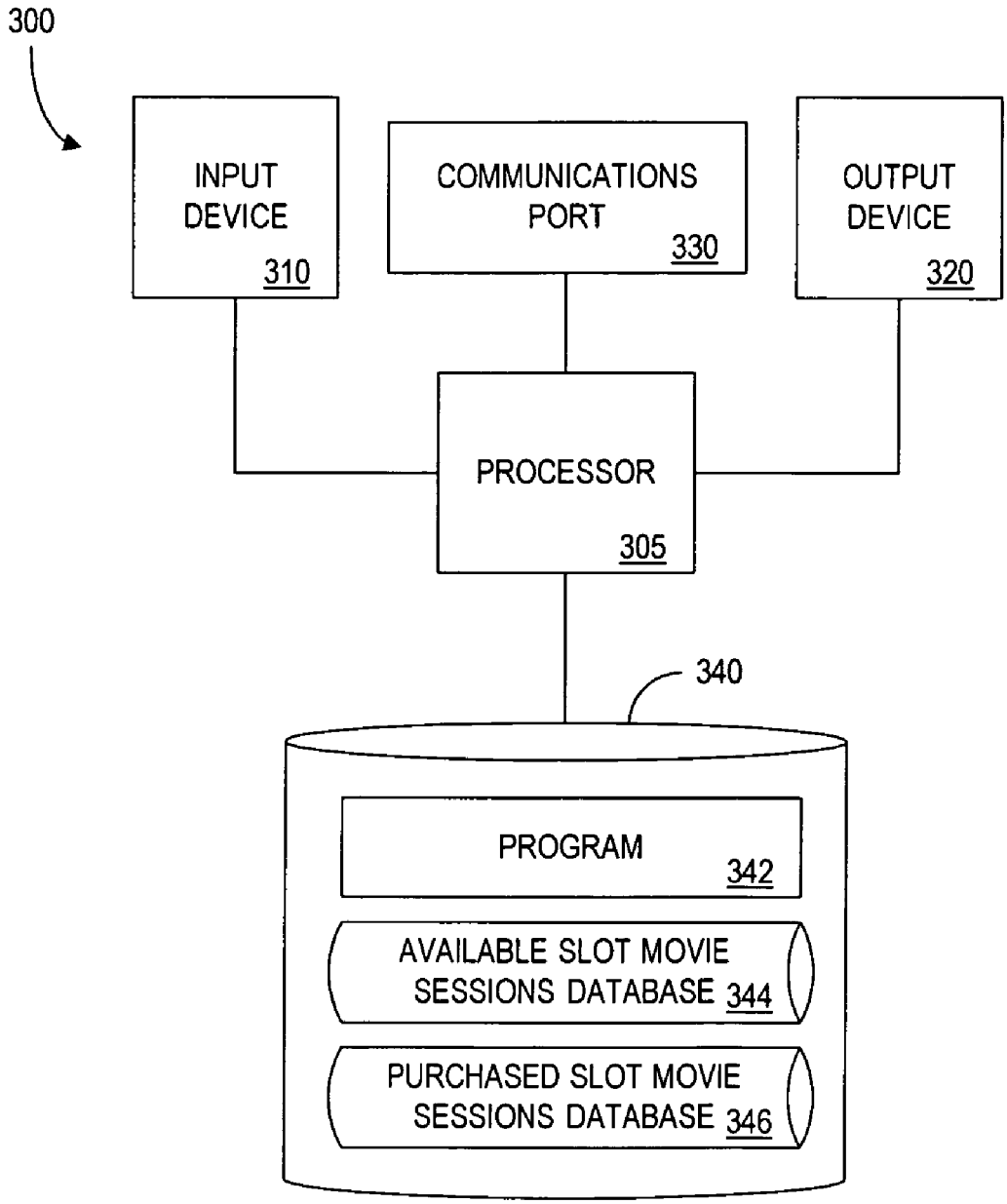
FIG. 3 is a block diagram of an example slot movie server consistent with at least one embodiment of the present invention.

Referring now to FIG. 3, illustrated therein is an embodiment 300 of an example slot movie server 140. Embodiment 300 is referred to as slot movie server 300 herein.

As described herein, a slot movie server may store information about one or more of (i) slot movie sessions available for purchase, (ii) slot movie sessions that have been purchased and/or generated, (iii) slot movies that have been created (e.g., in accordance with an available slot movie session) and are available for purchase, and (iv) slot movies that have been created and that have been purchased.

Slot movie server 300 includes a processor 305 operable to communicate with an input device 310, an output device 320, a communication port 330, and a storage device 340. Processor 305 may comprise one or more processors, such as one or more Intel™ Pentium™ processors.

The input device 310 may comprise any and all of the input devices described herein. Input device 310 may be operated by a casino attendant for inputting information about one or more slot movies and/or slot movie sessions. For example, a casino attendant may operate a keyboard comprising input device 310 to update information about a slot movie or slot movie session.

The output device 320 may comprise any and all of the output devices described herein. Output device 320 may be operable to output information related to one or more slot movie sessions available for purchase and/or one or more slot movies available for purchase. Similarly, output device 320 may be operable to output information related to one or more slot movies that have been purchased and/or one or more slot movies sessions that have been purchased. In one or more embodiments, output device 320 may be operable to provide a printed receipt or indication of a slot movie or slot movie session. For example, in one embodiment output device 320 may be operable to print a description of one or more movie sessions available for purchase.

Communication port 330 may comprise a means for the slot movie server 300 to communicate with one or more devices.

The storage device 340 may comprise an appropriate combination of magnetic, optical and/or semiconductor memory, and may include, for example, Random Access Memory (RAM), Read-Only Memory (ROM), a compact disc and/or a hard disk. The storage device 340 may comprise or include any type of computer-readable medium. The processor 305 and the storage device 340 may each be, for example: (i) located entirely within a single computer or other device; or (ii) connected to each other by a remote communication medium, such as a serial port cable, telephone line or radio frequency transceiver. In one embodiment, the slot movie server 300 may comprise one or more devices that are connected to a remote server computer for maintaining databases.

The storage device 340 stores a program 342 for controlling the processor 305. The processor 305 performs instructions of the program 342, and thereby operates in accordance with the present invention, and particularly in accordance with the methods described in detail herein. The program 342 may be stored in a compressed, uncompiled and/or encrypted format. The program 342 furthermore includes program elements that may be necessary, such as an operating system, a database management system and "device drivers" for allowing the processor 305 to interface with computer peripheral devices. Appropriate program elements are known to those skilled in the art, and need not be described in detail herein. The program 342 may further include one or more subroutines for carrying out methods of the present invention. For example, the program 342 may include a subroutine for updating a value of a parameter defining a slot movie session based on the occurrence of one or more predetermined events.

According to an embodiment of the present invention, the instructions of the program 342 may be read into a main memory from another computer-readable medium, such as from a ROM to RAM. Execution of sequences of the instructions in program 342 causes processor 305 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The storage device 340 also stores a plurality of databases, including an available slot movie sessions database 344 and a purchased slot movie sessions database 346. The available slot movie sessions database 344 may store data defining one or more slot movie sessions available for purchase or execution by a gaming device. An exemplary data structure for the available slot movie sessions database is described below with respect to FIG. 5. The purchased slot movie sessions database 346 may store data defining one or more slot movie sessions purchased by a player. An exemplary data structure for purchased slot movies database 348 is described below with reference to FIG. 6. In embodiments in which slot movies are generated without prior purchase or request of a player (e.g., slot movies are created and sold as pre-packaged products in a casino gift shop), the slot movie server 300 may also store an available slot movies database (not shown) that stores data defining one or more slot movies previously created and available for purchase.

Note that, although databases 346 and 348 are described as being stored in a slot movie server, in other embodiments of the present invention some or all of these databases may be partially or wholly stored in another device, such as the slot network server 130. Further, some or all of the data described as being stored in the databases 346 and 348 may be partially or wholly stored (in addition to or in lieu of being stored in the storage device 340 of the slot movie server 300) in a memory of one or more other devices, such as one or more of the slot network server 130 and/or the fulfillment server 160. A slot movie server may include different and/or additional components that have not been described herein.

Figure 4:
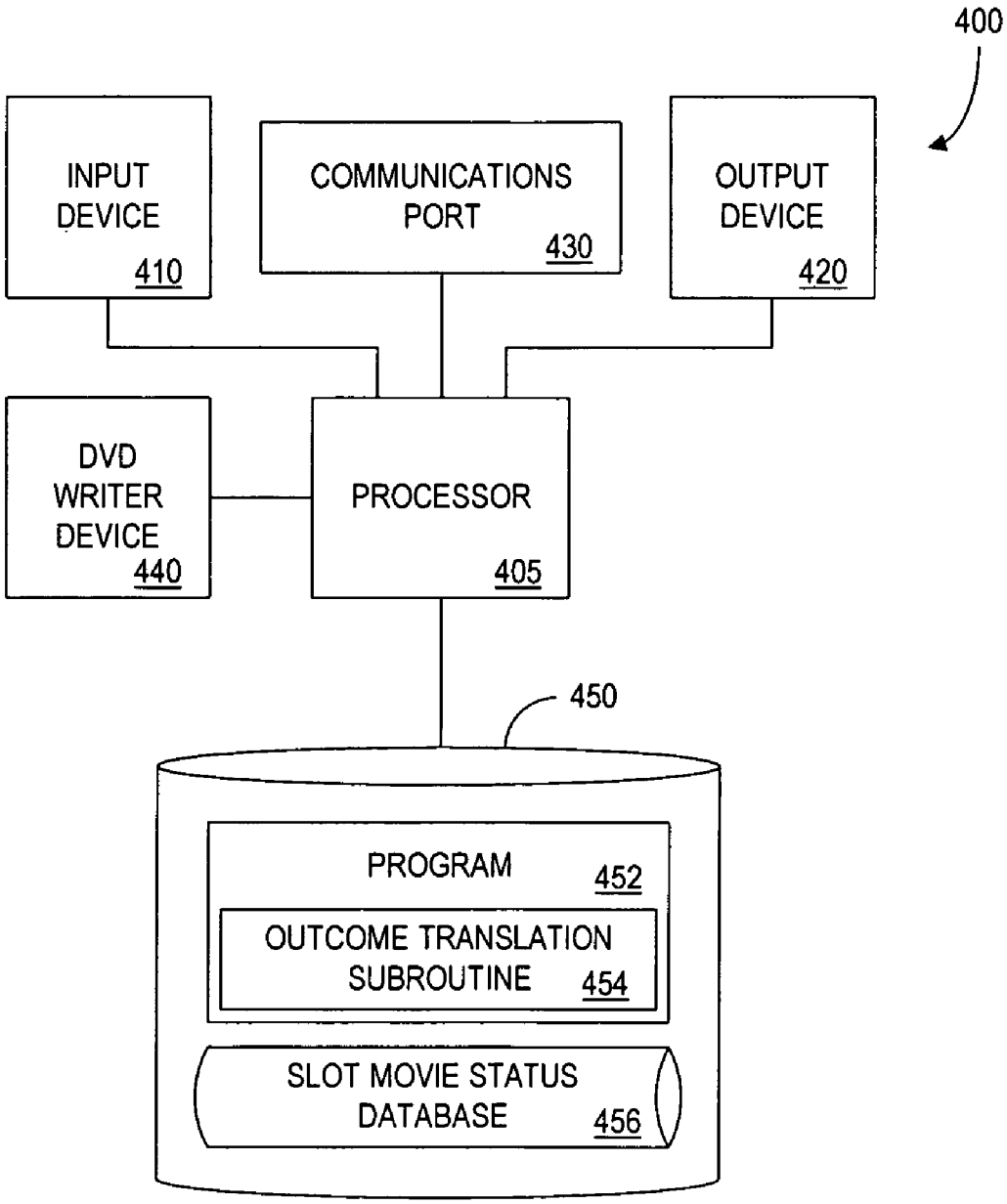
FIG. 4 is a block diagram of an example fulfillment server consistent with at least one embodiment of the present invention.

Referring now to FIG. 4, illustrated therein is an embodiment 400 of an example fulfillment server 160. Embodiment 400 is referred to as fulfillment server 400 herein. The fulfillment server 400 includes a processor 405 that is operable to communicate with an input device 410, an output device 420, a communication port 430, a DVD writer device 440 and a storage device 450. Processor 405 may comprise one or more processors, such as one or more Intel™ Pentium™ processors.

The input device 410 may comprise any and all of the input devices described herein. Input device 410 may be operated, for example, by an attendant for inputting information about one or more slot movies and/or slot movie sessions. For example, a casino attendant may operate a keyboard comprising input device 410 to update information about how a slot movie is to be created or otherwise handled, based on data representative or indicative of outcomes generated by a gaming device. For example, an operator of the fulfillment server 400 may operate input device 410 to program the fulfillment server to include particular information (e.g., a particular menu screen configuration) on a DVD of outcomes generated by a gaming device.

The output device 420 may comprise any and all of the output devices described herein. Output device 420 may be operable to output information related to one or more slot movies being created, that have been created, and/or for which data has been received.

Communication port 430 may comprise a means for the fulfillment server 400 to communicate with one or more devices.

The DVD writer device 440 may comprise any device operable to write data to a DVD. For example, in one embodiment the DVD writer device may comprise a device operable to write data in a DVD+R format and/or a DVD-R format. As would be understood by one of ordinary skill in the art, in one or more embodiments the DVD may be written in a format such as DVD+R or DVD-R such that the data can only be recorded once on the DVD and then the data becomes permanent on the disc. It should be understood that if fulfillment server 400 stores data representative or indicative of outcomes on a medium other than a DVD, the fulfillment server 400 may include another component operable to store data on such a medium. For example, if fulfillment server 400 stores data on a CD-ROM, the fulfillment server 400 may include a CD-ROM burner (e.g., in addition to or instead of a DVD writer device).

The storage device 450 may comprise an appropriate combination of magnetic, optical and/or semiconductor memory, and may include, for example, Random Access Memory (RAM), Read-Only Memory (ROM), a compact disc and/or a hard disk. The storage device 450 may comprise or include any type of computer-readable medium. The processor 405 and the storage device 450 may each be, for example: (i) located entirely within a single computer or other device; or (ii) connected to each other by a remote communication medium, such as a serial port cable, telephone line or radio frequency transceiver. In one embodiment, the fulfillment server 400 may comprise one or more devices that are connected to a remote server computer for maintaining databases.

The storage device 450 stores a program 452 for controlling the processor 405. The processor 405 performs instructions of the program 452, and thereby operates in accordance with the present invention, and particularly in accordance with the methods described in detail herein. The program 452 may be stored in a compressed, uncompiled and/or encrypted format. The program 452 furthermore includes program elements that may be necessary, such as an operating system, a database management system and "device drivers" for allowing the processor 405 to interface with computer peripheral devices. Appropriate program elements are known to those skilled in the art, and need not be described in detail herein. The program 452 may further include one or more subroutines for carrying out methods of the present invention. For example, as illustrated, the program 452 may include an outcome translation subroutine 454 for translating data indicative or representative of outcomes generated by a gaming device into a video representation format. For example, the outcome translation subroutine may store steps for how the data is to be decrypted, decoded or otherwise interpreted, such that game indicia and/or a payout may be determined for each game play defined by the corresponding slot movie. In one embodiment, fulfillment server 400 may store one or more video presentation creation subroutines (not shown) that comprise steps directing the processor 405 to create a video presentation in a particular manner. For example, such a video presentation creation subroutine may direct the processor 405 or another processor to create a particular number of tracks, particular menu screens, particular information for particular tracks.

In one embodiment, a DVD or other storage medium may include more than one version of the same video presentation (i.e., of the same set of outcomes). For example, in one embodiment a DVD may include (i) a "slow speed" version of a video presentation that displays the outcomes of the slot video movie at a first speed, (ii) a "normal speed" version of the video presentation that displays the outcomes of the slot movie at a second speed that is greater than the first speed, (iii) a "fast speed" version of the video presentation that displays the outcomes of the slot movie at a third speed that is greater than the second speed, and (iv) a "manual mode" version that requires an input from a user before an outcome is displayed (e.g., thus simulating slot machine play in which an outcome is displayed in response to an input from a player). Differences in speeds at which the outcomes are displayed may be accomplished, for example, by modifying an interval of time between display of respective outcomes and/or by modifying the amount of time for displaying the resolution of each respective outcome (e.g., modifying the speed at which the reels spin). Thus, in such an embodiment the processor 405 or another processor (e.g., a processor of the DVD writer device 440) may be programmed to create and store the various versions of the video presentation in accordance with a slot movie creation subroutine.

According to an embodiment of the present invention, the instructions of the program 452 may be read into a main memory from another computer-readable medium, such from a ROM to RAM. Execution of sequences of the instructions in program 452 causes processor 405 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The storage device 450 also stores a slot movie status database 456. The slot movie status database may store data defining one or more video presentations to be created, that have been created, or for which data has been received. An exemplary data structure for the slot movie status database 456 is described below with respect to FIG. 7.

Note that, although the database 456 is described as being stored in a fulfillment server, in other embodiments of the present invention some or all of the database may be partially or wholly stored in another device, such as the slot movie server 140 and/or the slot network server 130. Further, some or all of the data described as being stored in the database 456 may be partially or wholly stored (in addition to or in lieu of being stored in the storage device 450 of the fulfillment server 400) in a memory of one or more other devices, such as one or more of the slot network server 130 and/or the slot movie server 140. A fulfillment server may include different and/or additional components that have not been described herein.

4. Databases

Referring now to FIG. 5, illustrated therein is a tabular representation 500 illustrating an exemplary data structure of an available slot movie sessions database 344. The tabular representation 500 includes a number of example records or entries, each defining a slot movie session that may be (i) purchased by a player and/or (ii) utilized to provide, to a gaming device, one or more instructions for generating a plurality of outcomes. Those skilled in the art will understand that the available slot movie sessions database may include any number of entries. The tabular representation 500 also defines fields for each of the entries or records. The fields specify: (i) a slot movie session identifier 502 that identifies a slot movie session; (ii) a game(s) field 504 that indicates the one or more games for which outcomes are to be generated; (iii) a number of outcomes 506 that indicates the number of outcomes to be generated for a slot movie; (iv) a number of lines field 508 that indicates a number of paylines or other resolutions per game play of the corresponding game; (v) a bet per line field 510 that indicates the wager per payline or other resolution for each game play; (vi) a total price 512 for the slot movie session; and (vii) an additional condition(s) field 514 that stores an indication of one or more conditions that will be applied during play of the game corresponding to the slot movie session. Of course, other data may be stored (e.g., a starting balance). A slot movie server 140 or other device may utilize the tabular representation 500 to determine information about slot sessions available in the system The slot movie identifier 502 may be, for example, an alphanumeric identifier that uniquely identifies a slot movie session. Of course, the slot movie session identifier may be in any form that is convenient.

Although field 504 stores a title of a game in text form, an indication of a game, may be stored in any form (e.g., a numeric identifier that is a link to another table, etc.). Further, although field 504 stores an indication of a type of gaming device on which the game is played (e.g., five reel video reel slot machine), such information is not necessary and/or may be stored in a separate field or table.

The number of outcomes field 506 stores an indication of a duration of the corresponding slot video session that is defined by a number of outcomes to be generated for the slot video that may result from a gaming device generating outcomes in accordance with the corresponding slot movie session. Thus, for example, slot movie session "S-12345" lasts a duration defined by 1,500 outcomes (i.e., the session ends when 1,500 outcomes have been generated for a slot movie). As described, in one embodiment all resolutions associated with a game play or handle pull comprise a single outcome (e.g., all three respective resolutions on a three-reel slot game comprise a single outcome). Thus, in such an embodiment the number of outcomes field 506 may just as likely be named the number of game plays or number of handle pulls field.

It should be noted that in some embodiments a slot movie session duration may be defined by a maximum period of time rather than or in addition to a maximum number of outcomes. For example, a player purchasing a slot movie session may be purchasing one hour of game plays (however many game plays that turns out to be) of a particular game or games.

The number of lines field 508 stores an indication of the number of lines to be played for each game play of the game defined by the gaming session.

The bet per line field 510 indicates the amount to be wagered for each resolution corresponding to an outcome. Thus, for example, the first record of tabular representation 500 indicates that of the $10.00 paid for the slot session identified as "812345", $0.10 is to be wagered on each of the five paylines to be played for each of the 1,500 game plays to be played.

The price field 512 stores the price to be paid for a slot movie defined by a corresponding slot movie session. Thus, for example, a slot movie of 1,500 outcomes of the "Around the Track" game played on a five-reel video slot machine may be purchased for $10.00, as illustrated by the first record of tabular representation 500. It should be noted that, in one or more embodiments, a player need not pay for a slot movie and thus a price may not be applicable. For example, a casino or slot manufacturer may provide a slot movie defined by a particular slot movie session as a gift or prize to a player. Further, although the example prices illustrated in field 512 are in the form of currency, it should be understood that any form of consideration is within the scope of the present invention. For example, a player may provide consideration in the form of one or more of: (i) comp points or other alternate currency, (ii) a promise to perform one or more activities, (iii) performance of one or more qualifying activities, and (iv) forfeiture of a value due to the player.

The additional condition(s) field 514 stores an indication of condition(s), if any, that a player purchasing a corresponding slot movie session or a slot movie defined by a corresponding slot movie session agrees to. For example, in some games one or more decisions may be required of a player during game play. For example, in video poker a player typically has to decide which cards to hold (and thus which cards to discard) and in some bonus rounds a player may be asked to decide which of a plurality of courses to pursue (e.g., which of a plurality of boxes to open). For such games, additional conditions field 514 may store an indication of how such decisions are to be made by the gaming device executing the slot movie session. The additional conditions field 514 may also store an indication of other conditions by which a purchaser of the corresponding slot movie session or a slot movie resulting from the corresponding slot movie session must abide.

Thus, fields 504-514 represent various parameters defining the slot movie session of each entry, and the data stored in each field represents the value for each parameter. It should be understood that parameters different from, or in addition to, those illustrated by tabular representation 500 may be used to define a slot movie session. For example, in one embodiment a slot movie session may define a particular gaming device on which the outcomes for a slot movie are to be generated.

In one embodiment, a player may be allowed to select one or more of a plurality of qualifying gaming devices on which the outcomes are to be generated. Thus, the tabular representation 500 may store an indication of the one or more qualifying gaming devices (e.g., by storing an identifier of each such gaming device). In such an embodiment, the player may select a particular movie session and further specify the one or more particular gaming devices. The one or more particular gaming devices selected by the player may be stored in association with the slot session identifier of the slot movie session selected by the player (e.g., in the purchased slot movie sessions database, an example tabular representation of which is described below).

Referring now to FIG. 6, illustrated therein is a tabular representation 600 illustrating an exemplary data structure of a purchased slot movie sessions database 346. The tabular representation 600 includes a number of example records or entries, including records R-601, R-603, R-605 and R-607, each defining a slot movie session that has been purchased by a player. Those skilled in the art will understand that the purchased slot movie sessions database may include any number of entries. The tabular representation 600 also defines fields for each of the entries or records. The fields specify: (i) a player identifier 602 that identifies the player who purchased a particular slot movie session, (ii) a slot movie identifier that uniquely identifies the slot movie resulting from the players purchase of the particular slot movie session, (iii) a status 606 of the slot movie, (iv) delivery instructions 608 for providing the resulting slot movie to the corresponding player, and (v) a gross payout 610 corresponding to the slot movie resulting from the player's purchase of a particular slot movie session.

A purchased slot movie sessions database may be utilized, for example, to store and/or update information about a slot movie session purchased by a player and/or a slot movie to be created or created for a player. It should be noted that, in one embodiment, a slot movie purchased by a player may be conceptualized as a purchase by a player of a plurality of outcomes to be generated in accordance with the parameter values defining a particular slot movie session and thus a purchase of the slot movie session. It should further be noted that a slot movie is unique (it is comprised of a set of outcomes generated by a gaming device in accordance with the parameter values defining a particular session) and thus a purchase of a slot movie makes the slot movie unavailable for purchase by another. A purchase of a slot movie session, in contrast, does not render the slot movie session unavailable for purchase by another since another player may subsequently purchase a slot movie the outcomes of which are to be generated in accordance with the same slot movie session, thereby "purchasing" the same slot movie session.

In one embodiment, a purchased slot movie sessions database may be utilized by system 100 to queue the generation of outcomes by a gaming device in accordance with the slot movie session defined by a record. For example, in one embodiment a record in a purchased slot movie sessions database may be created upon the purchase of a slot movie session by a player. For example, slot movie server 140 may assign a unique identifier to the purchase (e.g., a slot movie identifier) and place a request to generate outcomes in accordance with the purchased slot movie session. For example, the request may comprise a request to be fulfilled by a casino attendant, as described herein. In another example, the request may be a request to be fulfilled by electronically prompting a gaming device to generate outcomes (e.g., the request may be placed in a queue of slot network server 130).

The player identifier 602 identifies the player who has purchased the corresponding slot movie and/or on whose behalf the outcomes for the slot movie have been generated or are to be generated. The slot movie identifier 604 uniquely identifies the movie purchased by the player. For example, in one embodiment when a player purchases a slot movie session, a slot movie identifier is created. The slot movie identifier may be created such that it includes the slot movie session identifier on which the slot movie is to be based. In another embodiment, the slot movie identifier may not be based or otherwise include the slot movie session identifier on which the slot movie is to be based. Rather, for example, the slot movie session identifier may be stored in a separate field of the purchased slot movie sessions database or be otherwise associated with the slot movie identifier.

The status field 606 stores an indication of a current status of a corresponding slot movie. It should be noted that the statuses illustrated in tabular representation 600 are exemplary only and additional or different statuses may be used. For example, record R601 shows that the slot movie identified as "S-12345-90113250" has an associated status of "purchased" which may indicate that the slot movie session "S-12345" has been purchased by a player but no outcomes have yet been generated for the slot movie. In another example, record R-603 shows that the slot movie identified as "S-1234570412619" has an associated status of "outcomes generated", which may indicate that outcomes for the slot movie have been generated but not yet transmitted to fulfillment server 160. In yet another example, record R-605 shows that the slot movie identified as "S78901-53210611" has an associated status of "outcomes transmitted", which may indicate that outcomes for the slot movie have been generated by a gaming device and transmitted to the fulfillment server 160. In still another example, record R-607 shows that the slot movie identified as "S-91324-9246001O" has an associated status of "redeemed", which may indicate that the gross payout associated with the slot movie has been redeemed.

Redemption of a gross payout for a movie may occur in a variety of manners, as described herein. In one embodiment, a player may provide proof of possession of a slot movie and in exchange be provided with the gross payout associated with the slot movie. In such an embodiment, the proof of possession may be considered a bearer instrument, such that any person presenting the proof of possession may be provided with the associated gross payout if the gross payout has not yet been redeemed. Such proof of possession may comprise the DVD or other medium on which the slot movie is stored and/or a receipt or other token storing an indication of the movie (e.g., a player tracking card or other player identifier). For example, in one embodiment a purchaser of a slot movie may be provided with a receipt. The receipt may have printed or otherwise stored thereon one or more of the following information: (i) slot movie identifier, (ii) gross payout amount, (iii) gaming device identifier(s) identifying the one or more gaming devices on which the outcomes were generated, (iv) time of generation of the outcomes, (v) a time at which the slot movie was purchased, (vi) an attendant identifier identifying an attendant who directed a gaming device to generate the outcomes for the slot movie, (viii) a cashless gaming receipt identifier and/or (ix) any other information useful for auditing or verification of payout information for the slot movie.

With respect to item (viii) in the list above (a cashless gaming receipt identifier), it should be noted that in one embodiment a gaming device that generated outcomes in accordance with embodiments described herein (e.g., outcomes in accordance with a particular slot movie session) may print or otherwise output (i) an indication or representation of the generated outcomes, and (ii) a cashless gaming receipt redeemable for the gross payout associated with the generated outcomes. The gross payout associated with the generated outcomes may comprise the sum of all outcomes generated for the slot movie for which the cashless gaming receipt is printed. The cashless gaming receipt may be stored in the casino's records, and retrieved for verifying and/or authorizing a payout for a slot movie. For example, the casino attendant who caused the gaming device to generate outcomes for a slot movie may place the cashless gaming receipt in an appropriate casino file. In one embodiment, such a cashless gaming receipt may have the slot movie identifier of the associated slot movie printed thereon. In one embodiment, more than one cashless gaming receipt may be associated with a single slot movie (e.g., in instances in which outcomes for the slot movie are generated on more than one gaming device). In one embodiment, rather than (or in addition to) printing a cashless gaming receipt, a gaming device may be operable to electronically transmit, to another device (e.g., slot movie server 140) an indication of a gross payout associated with a slot movie for which the outcomes corresponding to the gross payout were generated. In one embodiment, the tabular representation 600 may store a payout identifier and/or cashless receipt identifier associated with the slot movie (e.g., for facilitating retrieval of the appropriate cashless gaming receipt from a casino file to verify and/or authorize redemption of a gross payout). In one embodiment, once a gross payout is redeemed, any cashless gaming receipt associated with the gross payout may be destroyed or otherwise invalidated.

As described, in one or more embodiments, the proof of possession may be a bearer instrument. However, in another embodiment a slot movie is associated with a particular identified person (e.g., with a player identified by a player identifier) and only the identified person, upon providing appropriate proof of identification, may be allowed to redeem the gross payout. In such embodiments, a player who purchases a slot movie for another person (e.g., as a gift) may be required to transfer ownership of the slot movie or otherwise authorize redemption of the gross payout associated with the slot movie by providing an indication of the other person.

The delivery instructions 608 store an indication of how the slot movie is to be provided to the player who purchased the slot movie. In one embodiment, this information is transmitted to fulfillment server 160 for use by the fulfillment server in providing the slot movie to the player. In one embodiment, the delivery instructions do not specify a particular address but rather a type of address (e.g., as illustrated in tabular representation 600, delivery instructions may specify a postal address, a work e-mail address, and/or a home e-mail address (e.g., such that outcomes may be e-mailed to players)). The player identifier 602 may be used to access a player database (not shown) that stores additional information about a player, including the particular address described in the delivery address. As would be understood by one of ordinary skill in the art, a player database may store various information about a player, such as contact information, financial account information, number of comp points earned, gambling history information, preferences, etc.

The gross payout field 620 stores an indication of the gross payout associated with the slot movie. As illustrated in record R-603, a gross payout may be negative. In one embodiment, a player is not responsible for a negative payout. Thus, a negative gross payout may effectively be considered a zero payout in such embodiments.

A purchased slot movie sessions database may store additional and/or different information from that illustrated in tabular representation 600. For example, a purchased slot movie sessions database may store instructions for how a payout associated with a slot movie is to be provided to the player (e.g., whether it is to be mailed to the player in the form of a check, stored for the player in a casino account, credited to a financial account specified by the player, etc.). In another example, the purchased slot movie sessions database may store more detailed information for each outcomes generated for the slot movie. For example, the game indicia corresponding to the outcome, information about intermediary outcomes (e.g., an initial hand in video poker), the time of generation and/or the respective payout corresponding to each outcome may be stored. In yet another example, a net payout for the slot movie (e.g., the sum of payouts for the generated outcomes less the price paid for the slot movie) may be stored.

Referring now to FIG. 7, illustrated therein is a tabular representation 700 illustrating an exemplary data structure of a slot movie status database 456. The tabular representation 700 includes a number of example records or entries, including record R-701, each defining a slot movie for which an indication of outcomes generated by a gaming device has been received. Those skilled in the art will understand that the slot movie status database may include any number of entries. The tabular representation 700 also defines fields for each of the entries or records. The fields specify: (i) a slot movie identifier 702 that uniquely identifies a slot movie; (ii) a status 704 of a corresponding slot movie; (iii) a player identifier 706 that identifies a player associated with the corresponding slot movie; (iv) delivery instructions 708 for how the corresponding slot movie is to be output; and (v) a casino property 710 that identifies a casino property at which the gaming device that generated the outcomes corresponding to the slot movie is located. The slot movie status database may be utilized, for example, by fulfillment server 160 to store and/or update information on one or more slot movies created or to be created by the fulfillment server 160. The slot movie status database may include additional information, such as a timestamp indicating a time at which a slot movie was created and/or output to a player.

Referring now to FIG. 8, illustrated therein is a tabular representation 800 illustrating an exemplary data structure of an outcomes database 260. The tabular representation 800 includes a number of example records or entries, each defining an outcome generated by a gaming device. Those skilled in the art will understand that the outcomes database may include any number of entries. The fields specify: (i) a time 802 at which an outcome was generated; (ii) an outcome indicia 804 that indicates the game indicia corresponding to the outcome; (iii) an outcome payout 806 that indicates the payout amount corresponding to the outcome; (iv) a mode 808 that indicates a mode in which the gaming device that generated the outcome was operating in at the time of generating the outcome; (v) an attendant identifier 810 that stores an identifier of an attendant, if any, that directed the gaming device to generate the outcome; (vi) a player identifier 812 that is a player identifier of a player tracking card inserted into the gaming device at the time the outcome was generated; and (vii) a slot movie identifier 814 that identifies the slot movie, if any, for which the corresponding outcome was generated. The outcomes database 260 may be utilized, for example, by one or more of a gaming device and another device (e.g., slot network server 130 and/or slot movie server 140) to determine information about outcomes generated by a gaming device.

It should be noted that the tabular representation 800 illustrates a running log of outcomes generated by a gaming device, such that a new entry is created upon the generation of each outcome by the gaming device. In another embodiment, a gaming device may be operable to create a new entry or record in a database upon the initiation of subroutine to generate a plurality of outcomes for a particular slot movie in accordance with parameter values defining a particular slot movie session. In such an embodiment, the new entry or record may include only information about the outcomes generated for the slot movie. An example of information that may be stored in such a record or entry is provided below:

Slot Movie ID=S-56789-90785634
Slot Movie Session ID=S-56789
Attendant ID=A-32-101
Time: 1/10/05: 6:18 am

| Outcome No. | Game Indicia | Outcome Payout |
|---|---|---|
| 1 | x-x-x | $0.25 |
| 2 | x-y-z | $0.00 |
| 3 | y-y-y | $0.50 |

GROSS PAYOUT=$12.00

It should be noted that the representations or indications of game indicia illustrated in both above and in tabular representation 800 are exemplary only. Additional or different data may be stored (e.g., wager per outcome, total price for movie, etc.). A representation or indication of game indicia may be stored in any format. For example, it may be stored in binary form (1s and 0s), a specified code, graphical representation, textual description, etc. It should further be noted that the form in which an indication or representation of game indicia or other information about an outcome is stored in a database may be different than the form in which an indication or representation of game indicia is stored on a medium output by the gaming device for purposes of being input to input/output device 150. The latter form, as described herein, may be in a machine-readable form such as a bar code and mayor may not be encrypted.

5. Processes

Figure 9:
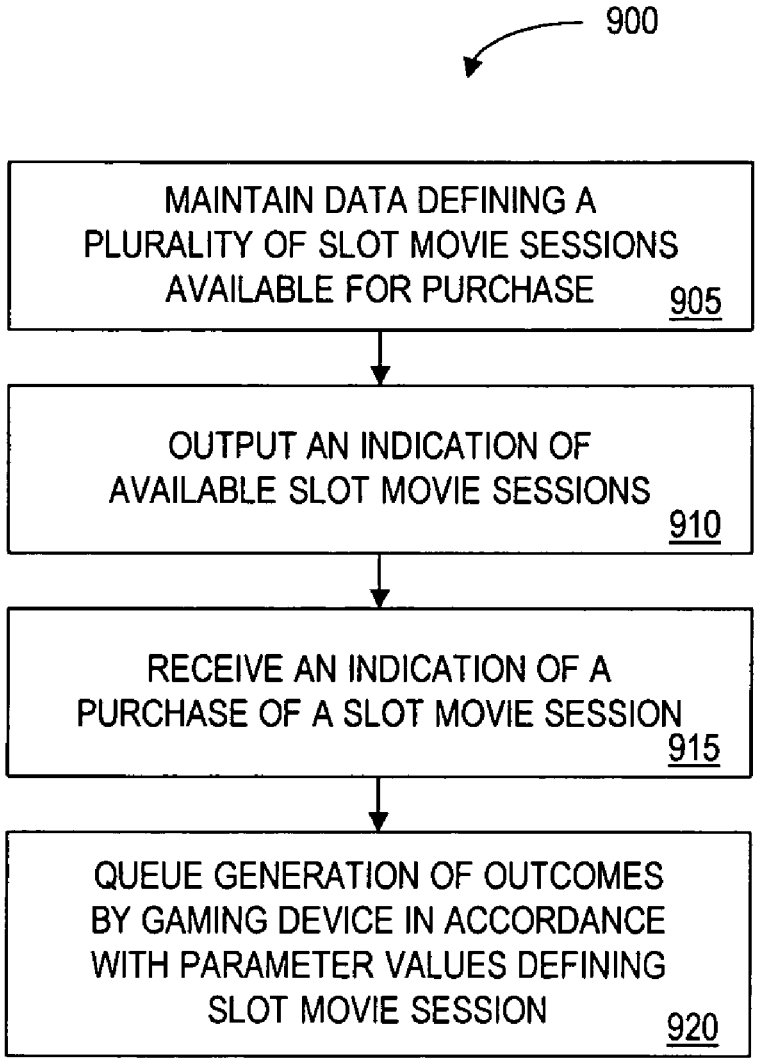
FIG. 9 is a flowchart illustrating a process consistent with at least one embodiment of the present invention.

Referring now to FIG. 9, illustrated therein is a flowchart depicting steps of an example process 900 consistent with one or more embodiments of the present invention. The process 900 may be performed, for example, by one or more of a slot movie server 140, a computing device operable to communicate with slot movie server 140 (e.g., a kiosk, computing terminal at a casino service desk, and/or a portable computing device operated by a casino attendant) and a gaming device.

Step 905 comprises maintaining data defining a plurality (or at least one) slot movie sessions available for purchase. This may comprise, for example, maintaining an available slot movie sessions database. In one embodiment, step 905 may comprise accessing such data as stored on another device besides the device performing step 905. In one embodiment, step 905 may comprise providing access (e.g., to another device and/or a casino employee) to the data, for purposes of updating, entering, and/or deleting the data. In one embodiment, step 905 may further comprise performing one or more subroutines to create, update and/or delete such data. For example, step 905 may include (or a gaming device operable to perform step 905 may further be operable to execute) one or more subroutines for determining a price or other parameter for an available slot movie sessions. The following copending, commonly-owned U.S. patent applications describe various methods for determining prices and other parameters for a plurality of outcomes to be purchased by a player: (i) U.S. application Ser. No. 10/001,089, filed Nov. 2, 2001 in the name of Walker et al. and entitled GAMING DEVICE FOR A FLAT RATE PLAY SESSION AND A METHOD OF OPERATING SAME; (ii) application Ser. No. 10/636,520, filed Aug. 7, 2003 in the name of Walker et al and entitled SYSTEM AND METHOD FOR COMMUNICATING GAME SESSION INFORMATION; and (iii) application Ser. No. 10/635,986, filed Aug. 7, 2003, Walker et al. and entitled SYSTEM AND METHOD FOR REMOTE AUTOMATED PLAY OF A GAMING DEVICE. Each of these applications is incorporated by reference herein for all purposes.

An indication of available slot movies is output in step 910. Step 910 may comprise, for example, outputting a menu of available slot movies via a display of a computing device (e.g., a display of a kiosk, computing device at a casino counter, gaming device, portable device operated by a casino attendant, etc.). In one embodiment, step 910 may comprise causing a printing of a menu of the available slot movie sessions. For example, a brochure or sign may be caused to be printed, providing information on one or more available slot movie sessions.

In step 915, an indication of a purchase of a slot movie is received. Such an indication may be received based on one or more of an input of a casino attendant and an input of a player. For example, in one embodiment a player may verbally request to purchase a particular slot movie session and a casino attendant may input the request into system 100. The indication received in step 905 may include information such as a player identifier, payment information, and customization information (e.g., a player's selection of a gaming device at which outcomes are to be generated and/or another value for another parameter defining the purchased slot movie session).

In step 920, the generation of outcomes by a gaming device in accordance with parameter values of the purchased slot movie session is placed in a queue. The queue may be a queue of a device (e.g., slot movie server 140, slot network server 130) operable to direct a gaming device to generate the outcomes as appropriate. In another embodiment, the queue may comprise a queue output to one or more casino attendants, based on which queue the casino attendants direct a gaming device to generate outcomes. In one embodiment, a request from such a queue is acted upon in the order in which it is received (e.g., based upon availability of the gaming device which is to generate the outcomes). In another embodiment, a request from such a queue is only acted upon when one or more predetermined conditions is satisfied (e.g., the current time is between 12:00 am and 8:00 am, a time at which a casino is not typically as busy and/or an activity status of the gaming device that is to generate the outcomes is a predetermined activity status).

As described herein, in one or more embodiments outcomes may be generated for slot movies even without purchase of a slot movie session by a player. For example, a casino may desire to create slot movies and sell them at a casino gift shop or service counter. In such an embodiment, the process 900 may be modified to allow for creation of such pre-packaged slot movies. For example, in one embodiment step 910 may not be necessary and step 915 may instead comprise determining that one or more conditions for creating a slot movie has been satisfied (e.g., an inventory of available pre-packaged slot movies has fallen below a predetermined threshold). Thus, the generation of outcomes may be placed in a queue in response to such a determination rather than in response to a purchase of a slot movie session.

Figure 10:
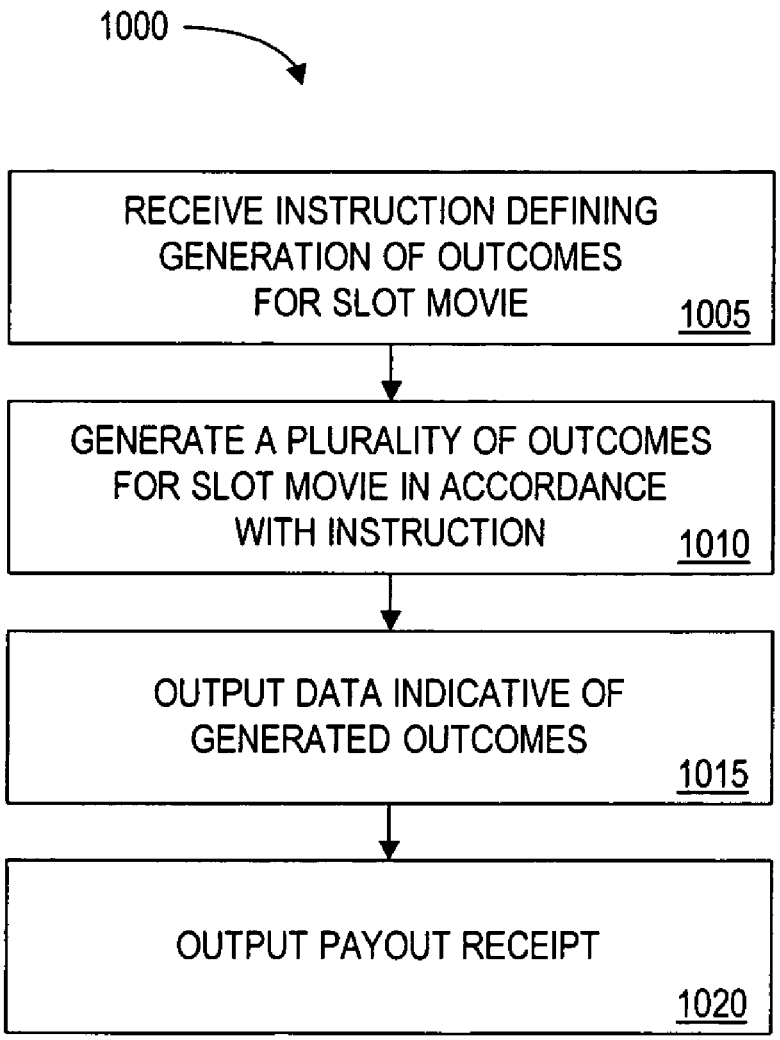
FIG. 10 is a flowchart illustrating a process consistent with at least one embodiment of the present invention.

Referring now to FIG. 10, illustrated therein is a flowchart depicting steps of an exemplary process 1000 that is consistent with one or more embodiments of the present invention. Process 1000 is a process that may be performed by a gaming device in order to generate outcomes for a slot movie. Process 1000 may comprise, for example, at least a part of a subroutine stored in a memory of a gaming device.

In step 1005, an instruction defining generation of outcomes for a slot movie is received. Such an instruction may comprise, for example, an identifier identifying a slot movie session in accordance with the parameter values of which the outcomes are to be generated. For example, a casino attendant or device may provide to a slot machine a slot movie session identifier. The gaming device may be operable to determine (e.g., by accessing from its own memory or the memory of another device) the one or more parameter values needed by the gaming device to execute the generation of outcomes. For example, the gaming device may need to determine the number of outcomes and/or any rules via which decisions during game play are to be executed. In one embodiment, a casino attendant or device provides information describing the generation of outcomes in addition to or in lieu of the slot movie session identifier. For example, the casino attendant or device may transmit an indication of the outcomes and rules to the gaming device. The instruction received in step 1005 may include additional information, such as a slot movie identifier, player identifier, and/or casino attendant identifier. In one embodiment, a gaming device may be operable to generate a slot movie identifier in response to the instruction. In one embodiment, the gaming device may enter "slot movie" mode upon receiving the instruction. The instruction may be received via an input device. An input device may comprise, for example, any of the input devices described herein.

In step 1010, the plurality of outcomes are generated in accordance with the instruction. It should be noted that, in one embodiment, the outcomes are generated in accordance with a slot movie subroutine, which may include different or additional steps from a conventional subroutine for generating outcomes. For example, when generating outcomes in a slot movie mode, the gaming device may (i) refrain from displaying certain information (e.g., the outcomes or corresponding payouts), (ii) display information specific to the slot movie mode (e.g., an indicator that the gaming device is operating in slot movie mode), (iii) refrain from performing certain activities (e.g., outputting payouts), (iv) display outcomes in an alternate manner (e.g., more per screen), and/or (v) perform activities specific to the slot movie mode (e.g., creating an entry or record to store the outcomes in memory, operating at a higher than normal speed).

As described herein, in one embodiment a gaming device operating in slot movie mode may operate much more rapidly than does a typical gaming device on the floor. For instance whereas a gaming device not operating in a slot movie mode may typically take several seconds to generate or display an outcome after the initiation of a handle pull, a gaming device operating in slot movie mode may generate outcomes within small fractions of a second of each other. By repeatedly generating outcomes quickly, a gaming device may generate, for example, ten thousand outcomes in a second. It may be advantageous for a gaming device to generate outcomes rapidly if a player is not physically present at the machine (as may be the case for a gaming device operating in slot movie mode), because there may be no reason to provide the drama of a delay prior to the resolution of an outcome. Therefore, outcomes may be generated more rapidly, with each outcome earning a positive expected return for the casino.

In one embodiment, a recorder device associated with a gaming device may be activated when the gaming device is operating in slot movie mode. Such a recorder device may be desirable to collect and/or store information helpful in auditing or verifying outcomes generated during slot movie mode. Such a recorder device may also be desirable to detect if a gaming device operating in slot movie mode has malfunctioned or has potentially malfunctioned.

For example, in one embodiment, two or more cameras are used to detect when something has gone wrong with the generation of outcomes for a slot movie. For example, the two or more cameras may be focused on the gaming device. The cameras each produce video feeds of activity at the gaming device. For example, the cameras may produce video feeds showing the reels of the slot machine comprising the gaming device, the credit meter of the slot machine, the payout meter, the coin tray, the bonus screen, etc. Another discrepancy would occur if two video cameras were monitoring the same feature of a slot machine, such as its reels. One video camera might provide a feed showing an outcome of "cherry-cherry-cherry," while the other camera might provide a feed showing an outcome of "cherry-cherry-bar." Upon detecting a discrepancy, the monitor may send a signal to the slot machine to stop generating the outcomes until the discrepancy in the video feeds can be fully investigated. The monitor may further send a signal to casino personnel in the vicinity of the slot machine to investigate the discrepancy. In one embodiment, microphones or other sensors may be used in place of, or in addition to video cameras. For example, a microphone may monitor the sound effects emanating from the slot machine. If a video feed of the slot machine indicates a large payout, but the microphone does not indicate sound effects consistent with a large payout, then a monitor may determine that something has gone wrong with the execution of a play session at the slot machine.

In one or more embodiments, the system 100 may include a scraping device operable to record data of a gaming device. Scraping devices may include any devices that can be affixed to a gaming device or placed in proximity to a gaming device, and that can retrieve information from the gaming device. For example, a scraping device may comprise a small camera that can be attached to a gaming device and can be directed at the outcome display area (e.g., the reels) of the gaming device. A scraping device may retrieve information by monitoring an outcome display area, a credit meter, a payout meter, a coin tray, or any other non-static feature of a gaming device. The scraping device may detect electromagnetic signals, acoustic signals, vibrations, and other signals produced by a gaming device. The scraping device may interpret such signals using a processor and software contained on a ROM, both internal to the scraping device. For example, a scraping device monitoring a payout meter may detect a change in light emissions from the payout meter, and interpret the change, using optical character recognition technology, to identify that the gaming device has generated an outcome corresponding to a payout of ten (10) credits.

A scraping device may also comprise a piece of hardware or software residing within the gaming device. Although it may be internal to the gaming device, a scraping device may not receive any direct signals from the processor of the gaming device. Instead, the scraping device may interpret outputs from the processor of the gaming device that have been sent to the reel controller, hopper controller, video display area, or other features of the gaming device. The scraping device may communicate any information it has retrieved from a gaming device to another device (e.g., the slot network server 130 via the slot network 120 and/or the slot movie server 140).

Embodiments where the slot movie server 140 or another device communicates with the scraping device provide advantages in that the slot movie server 140 need not communicate directly with a gaming device in order to e.g., track the progress of outcomes being generated for a slot movie. Therefore, a gaming device need not be retrofitted just to connect to the slot movie server 140. Instead, a scraping device can be attached to the gaming device.

One type of scraping device is a screen scraper, typically embodied as a computer program. A screen scraper is often used to translate data from the output of a first program into data suitable to be used by a second program. The translation process is used because the two programs operate on data that is formatted differently, and so cannot communicate directly with one another. The translation process occurs, in one case, when the older program outputs data to be displayed in a first format on a display screen, such as a CRT display. The screen scraper reads the data, and translates it from the first format to a second format. The screen scraper may then provide the data in the second format to the newer program, which can now understand the data and perform operations on the data that perhaps were not possible with the older program.

In one embodiment of the present invention, the initiation of slot movie mode at a gaming device includes a locking of the gaming device, such that the gaming device cannot be played by a player during slot movie mode. For example, slot network server 130 or the slot movie server 140 may transmit locking data to the gaming device or the casino attendant can input such data into the gaming device. In one embodiment, locking of the gaming device is a step of a slot movie mode subroutine. The locking data may comprise a signal that prevents the gaming device from accepting coins and entering conventional mode. The locking data may also be a signal that prevents a player from pulling a pull handle or otherwise initiating a manual play of the gaming device.

In one embodiment, step 1010 may comprise executing decisions during game play in accordance with one or more predetermined rules. As described, certain games for which slot movies may be purchased may require one or more decisions that are typically made by a player playing the game play (e.g., video blackjack machines, video poker machines, and the like). The inclusion of decision rules in the one or more instructions received during 1005, or the access to one or more such rules based on such instructions, may enable the gaming device to execute such decisions without player input. For example, a video poker game may be executed based on perfect game play rules (e.g., such that the cards to be held are ones that correspond to the highest expected value).

In step 1015, data indicative (or representative) of the outcomes generated for the slot movie is output. Output of such data may comprise, for example, output of one or more papers on which is printed one or more bar codes, each bar code representing at least one outcome and/or a gross payout for the slot movie. For example, in one embodiment a slot movie is created using outcomes that do not necessarily correspond to the outcomes generated by the gaming device, but the gross payout of which is equivalent to the gross payout of the outcomes generated by the gaming device.

In one embodiment, outputting the data may comprise electronically transmitting the data. In one embodiment, outputting the data may comprise providing access to the data.

In step 1020, a cashless gaming receipt is output. The cashless gaming receipt is redeemable for the gross payout corresponding to the outcomes generated. If the gross payout is a negative number, the cashless gaming receipt may not be printed or may not be redeemable for any cash value greater than zero or another specified amount. As described, in one embodiment such a payout receipt may be placed by a casino attendant in a casino file, for auditing or verifying the gross payout associated with the slot movie.

Figure 11:
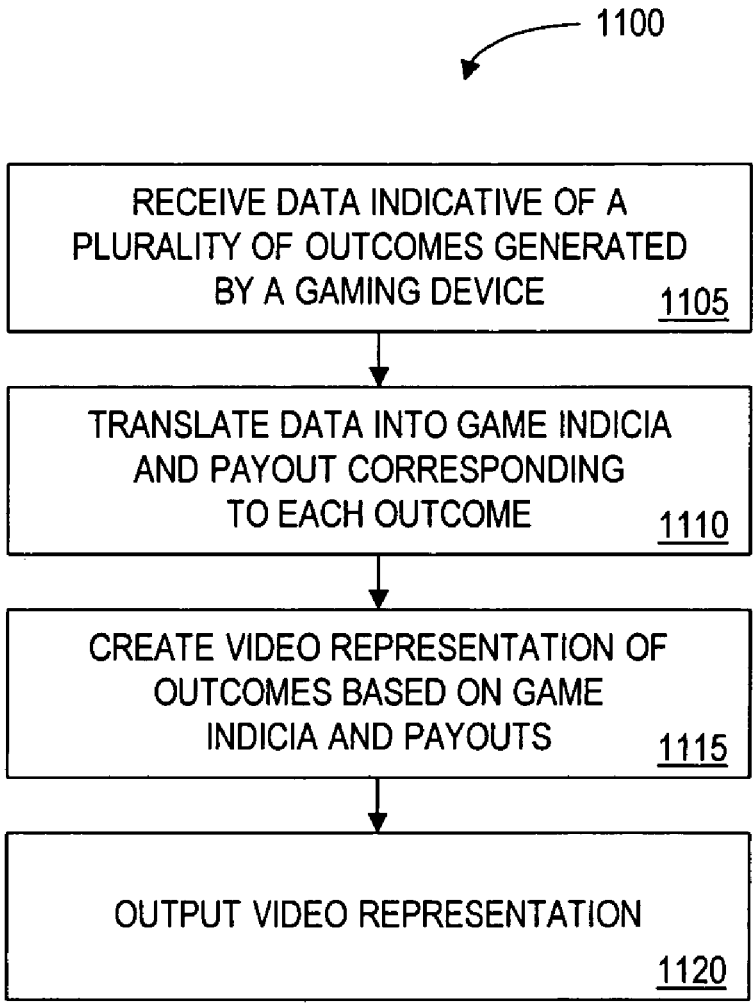
FIG. 11 is a flowchart illustrating a process consistent with at least one embodiment of the present invention.

Referring now to FIG. 11, illustrated therein is a flowchart illustrating an example process 1100 consistent with one or more embodiments of the present invention. The process 1100 may be performed, for example, process 1100 may be performed by a fulfillment server 160.

In step 1105 data indicative (or representative) of a plurality of outcomes generated by a gaming device is received. For example, such data may be received from input/output device 150. Such data may be, for example, in the form of an image file readable by the fulfillment server 150. For example, such data may be in the form of one or more codes on a paper that was scanned into the input/output device 150. In another example, the data may be in the form of a bar code that was scanned by a bar code scanner of input/output device 150. In one embodiment, the data may be in electronic form. In one embodiment, the data may be received from a device.

In step 1115, a video presentation of the outcomes is created. For example, one or more versions of the video presentation may be burned onto a DVD or other tangible medium. Creating the video presentation may comprise, for example, selecting graphical images representative of the outcomes and forming a video presentation that shows the graphical images in appropriate sequence. Creating the video presentation may further comprise, for example, creating one or more appropriate tracks for the DVD or other medium. For example, creating the video presentation may comprise selecting highlights of the outcomes (e.g., the fifty top-paying outcomes) and creating a video presentation of just the highlights.

In step 1120, the video presentation is output. Outputting the video presentation may comprise mailing a DVD on which the video presentation is burned, transmitting a file (e.g., a digital file) comprising the video presentation to an e-mail address associated with the video presentation, or making the video presentation available for viewing via a Web site. In embodiments in which a casino causes creation of slot movies for sale in a casino gift shop, outputting the video presentation may comprise mailing a DVD of the video presentation to a casino in a batch of DVDs, each DVD having stored thereon a unique slot movie.

In one embodiment, a player may purchase a slot movie session and, as a result, be provided access to viewing the outcomes defined by the slot movie session as the outcomes are displayed (or after a time at which the outcomes are displayed) on the gaming device generating the outcomes (e.g., rather than having a DVD of the outcomes mailed to the player). For example, a player may purchase a slot movie session comprising 1,500 outcomes for a particular game, the outcomes to be generated on a particular gaming device or type of gaming device. The slot movie session may define the manner in which the player may then be provided access to viewing the outcomes. For example, upon generation of the outcomes (or a subset of the outcomes), the player may be notified via e-mail that the player may view a video of the display of the outcomes. For example, a video camera associated with the gaming device on which the outcomes were generated or are being generated may be operable to capture the display of the outcomes and transmit the image(s) to a server (e.g., slot movie server 140 and/or slot network server 130), via which the player may subsequently view the image(s). For example, the gaming device may (periodically and/or upon the satisfaction of one or more conditions (e.g., the gaming device has not been busy for a predetermined period of time or is not currently busy)) generate a subset (e.g., ten) of the 1,500 outcomes defined by the purchased slot movie session. A video camera may capture one or more image(s) (still or moving images) of the display of the outcomes. The image file may then be transmitted to the player and/or the player may be informed of the availability of the image file. In another embodiment, the player may be allowed to view the display of the outcomes generated in accordance with the slot movie session purchased by the player in substantially real time. For example, a notification e-mail message (or pager or cellular phone message) may be transmitted to the player when the gaming device is generating the outcomes. The player may then log onto a designated Web site or Web page and view the display of the outcomes the player previously purchased via the slot movie session.

In the above embodiment, step 1105 may comprise receiving an indication of one or more outcomes substantially as the outcome(s) is generated or after a predetermined time from a time of the generation. In this embodiment, step 1110 may comprise manipulating one or more images or files of the display of the outcomes. For example, step 1110 may comprise decompressing an image file or otherwise translating the image file to another format or modifying the file or images stored therein. In this embodiment, steps 1115 and 1120 may be collapsed and together may comprise making the image(s) or files available for viewing by a player. For example, a file of the images or a link to the file may be e-mailed to a player. In another example, the player may be notified of the availability of the image(s) or file on a Web site associated with the casino or another entity practicing aspects of the invention.

In one embodiment, the display of the outcomes generated in accordance with the purchased slot movie session may be output as a streaming video over the Internet and the player may be notified of the availability of the streaming video when it becomes available.

Figure 12:
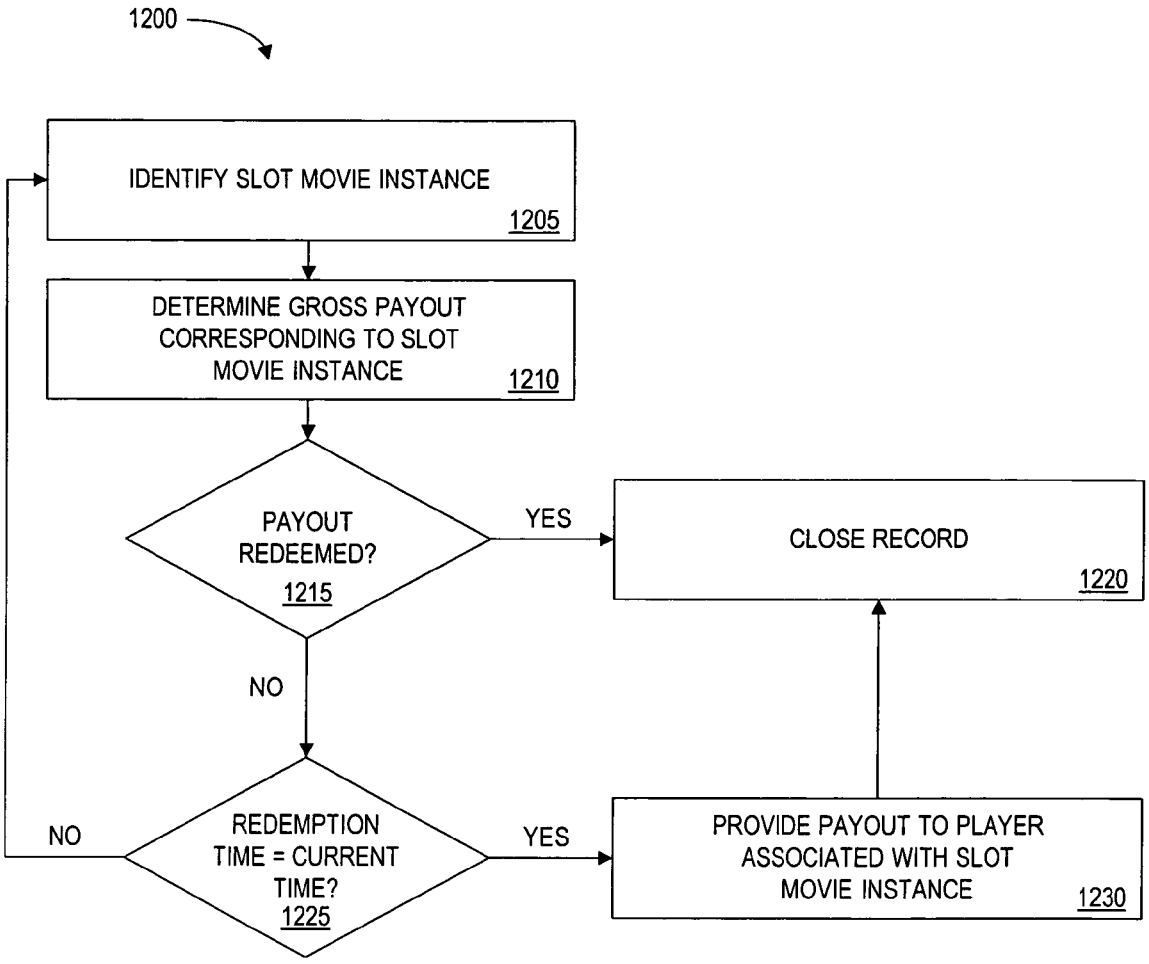
FIG. 12 is a flowchart illustrating a process consistent with at least one embodiment of the present invention.

Referring now to FIG. 12, illustrated therein is a flowchart depicting an example process 1200 for implementing one or more embodiments of the present invention. The process 1200 comprises a process for providing a payout corresponding to a slot movie purchased by a player. The process 1200 may be performed, for example, by slot movie server 140, slot network server 130 and/or another device.

As described herein, a payout (e.g., a gross payout) corresponding to a purchased slot movie may be provided to a player in a variety of manners. For example, in one embodiment a player may visit a casino (e.g., the casino in which the slot movie was purchased) to redeem the payout. For example, the player may present the DVD or another proof of possession in order to obtain the payout. For example, in one embodiment a receipt for a slot movie may be included in the jewel case of the DVD on which the slot video is stored. The player may present the receipt in order to redeem the payout. In another embodiment, the slot movie may be associated with the player identifier and the player need only provide his player identifier card or another form of identification in order to redeem the payout. In another embodiment, if a player does not affirmatively attempt to redeem a payout within a predetermined amount of time from a time at which the slot movie corresponding to the payout was purchased, the payout may by default be provided to the player.

In step 1200 a slot movie is identified. For example, a player may present a slot movie identifier to a casino attendant. Alternatively, the process 1200 may be performed on a periodic or non-periodic basis irrespective of whether a request for a payout has been received. For example, the record for each purchased slot movie may be reviewed in sequence to determine whether a payout should be output via a default manner. In any of these embodiments, identifying a slot movie may comprise retrieving a slot movie record from a purchased slot movie database.

The gross payout associated with the slot movie is determined in step 1210. The gross payout may be determined by (i) accessing a record of the purchased slot movie database based on the slot movie identifier, (ii) reading the gross payout indicated on a slot movie receipt presented by a player, and/or (iii) retrieving from a physical file a cashless gaming receipt associated with the slot movie.

In step 1215 it is determined whether the payout has already been redeemed. For example, a status of the slot movie may be checked to determine whether it indicates that the payout has been redeemed. If the payout has already been redeemed, a redemption of the payout may be denied and/or the record associated with the slot movie may be closed (step 1220).

If it is determined that the payout has not yet been redeemed, it may be determined whether the current time is a default redemption time (step 1225). For example, in one embodiment a check for the gross payout amount is mailed to the player once thirty (30) days from a time of purchase of the slot movie has passed. If the current time is a default redemption time, the process proceeds to step 1230, in which the payout associated with the slot movie is provided to the player associated with the slot movie.

For example, a casino attendant may be authorized to provide the payment to the player, to provide the cashless receipt associated with the slot movie to the player (e.g., for input by the player into a gaming device or kiosk operable to provide payment in exchange for the cashless gaming receipt). In another example, a check for the amount of the payout may be mailed to the player. In yet another example, a financial account associated with the player may be credited with the amount of the payout.

In one embodiment, step 1230 may comprise accessing one or more databases (e.g., a purchased slot movies database and/or a player database) to determine a player's preference for being provided the payout associated with the movie.

In one embodiment, a casino attendant may be directed to destroy or otherwise invalidate a cashless gaming receipt associated with the slot movie upon providing the payout to the player.

If it is determined, in step 1225, that the current redemption time is not equal to the current time, the process 1200 returns to step 1205. For example, the next open record of the purchased slot movies database may be retrieved.

Figure 13:
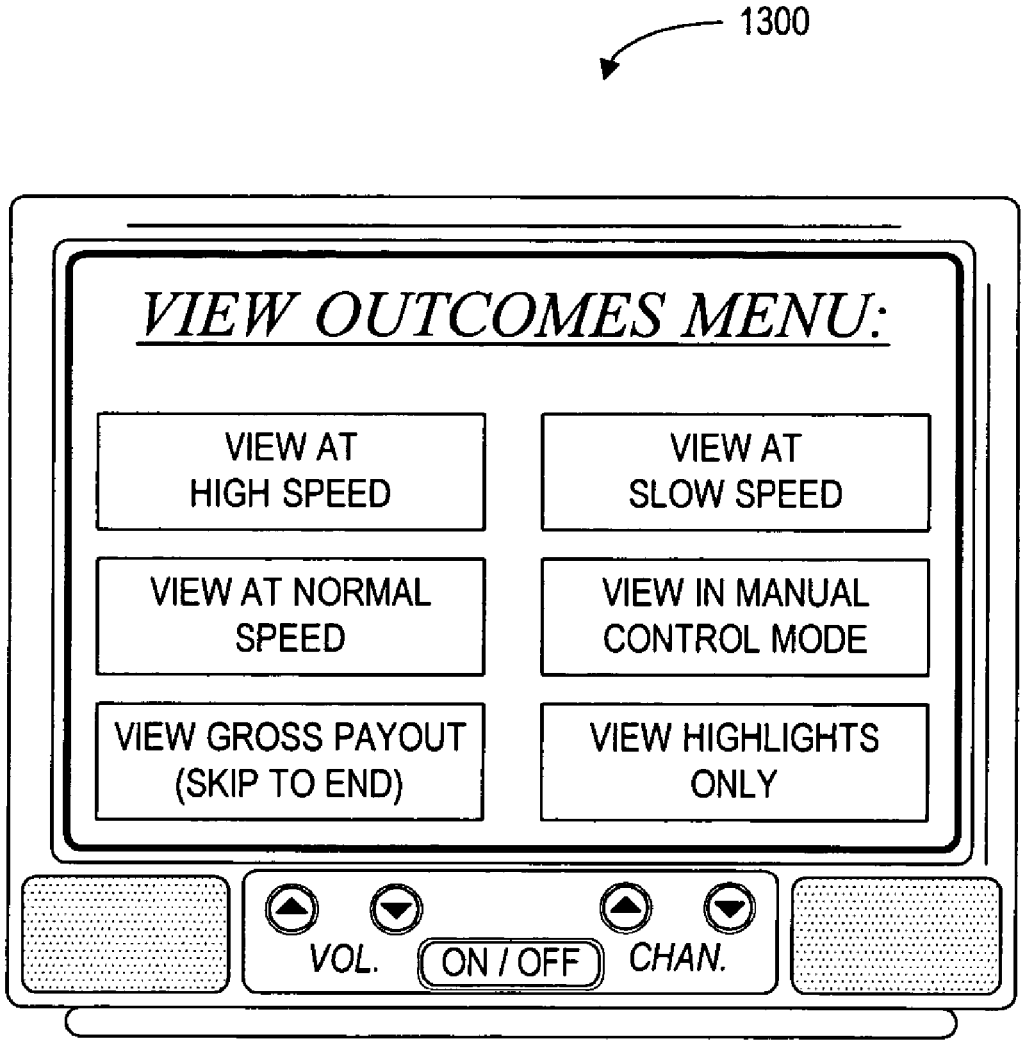

Referring now to FIG. 13, illustrated therein is an example of a screen (screen 1300) that may be presented to a player viewing a slot movie. The screen 1300 depicts a menu (e.g., a menu of DVD tracks) selectable by a player.

Figure 14:
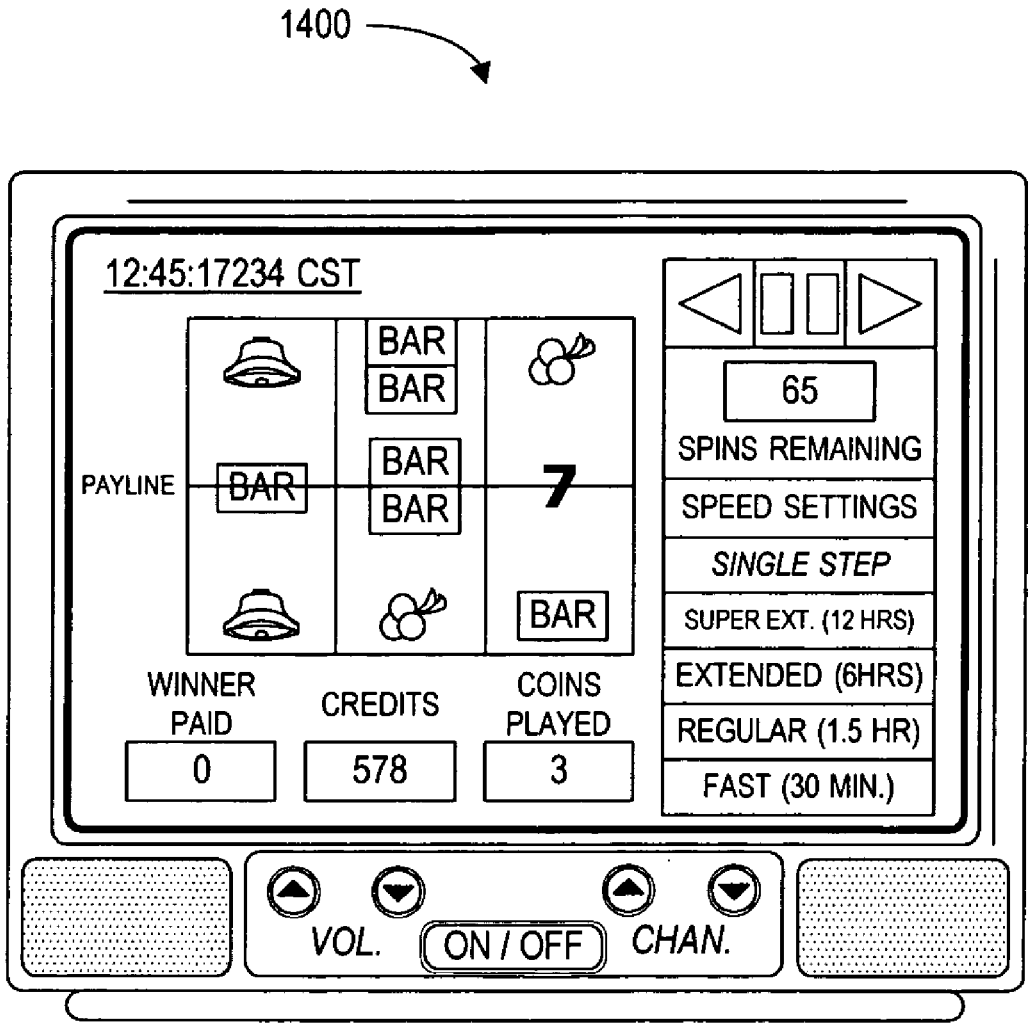

Referring now to FIG. 14, illustrated therein is an example of another screen (screen 1400) that may be presented to a player viewing a slot movie. The screen 1400 depicts the display of an outcome of a three reel slot machine as it may appear to a player viewing a slot movie.

CONCLUSION

There has thus been provided a method and apparatus of operating a gaming device, for example a slot machine, in an automated manner. The present invention permits a casino to significantly increase the usage and revenue of gaming devices, encouraging substantially continuous play at times when the machine might otherwise be un- or under-used. The invention further permits a player to enjoy all of the benefits of gambling, such as the enjoyment of viewing real-time gaming device results or previously generated device results, without necessitating a physical presence at the gaming device.

Although the present invention has been described in terms of certain preferred embodiments, other embodiments that are apparent to those of ordinary skill in the art are also intended to be within the scope of the present invention. Accordingly, the scope of the present invention is intended to be limited only by the claims appended hereto.

What is claimed is:

1. A gaming device comprising:

a display device;

an input device;

a processor; and a memory device which stores a program including a plurality of instructions, which when executed by the processor, cause the processor to operate with the display device and the input device to:

(a) at a first point in time:

(i) enable a wager associated with a play of a wagering game to be placed, and (ii) if the wager associated with the play of the wagering game is placed:

(A) randomly generate a wagering game outcome for the play of the wagering game, (B) display the randomly generated wagering game outcome, (C) determine if the randomly generated wagering game outcome is associated with one of a plurality of different awards, and (D) if the randomly generated wagering game outcome is associated with one of the plurality of different awards, provide said award; and (b) at a second, subsequent point in time:

(i) receive an instruction defining a plurality of outcomes; and (ii) generate the plurality of outcomes in accordance with the instruction, said generation of each of the plurality of outcomes occurring before any of the generated plurality of outcomes are displayed to any players.

2. The gaming device of claim 1, wherein when executed by the processor, the plurality of instructions cause the processor, at the second, subsequent point in time, to:

generate a first outcome upon receiving the instruction; and generate the second outcome without receiving any further input from a player.

3. The gaming device of claim 1, wherein when executed by the processor, the plurality of instructions cause the processor to receive the instruction from a casino attendant.

4. The gaming device of claim 3, wherein when executed by the processor, the plurality of instructions cause the processor to receive an identifier that identifies the casino attendant.

5. The gaming device of claim 1, wherein when executed by the processor, the plurality of instructions cause the processor to receive the instruction from a player.

6. The gaming device of claim 1, wherein when executed by the processor, the plurality of instructions cause the processor, at the second, subsequent point in time, to generate the plurality of outcomes on behalf of a player associated with the plurality of outcomes.

7. The gaming device of claim 1, wherein the plurality of outcomes are associated with an identifier that uniquely identifies a player.

8. The gaming device of claim 1, wherein when executed by the processor, the plurality of instructions cause the processor to:

facilitate the provision of a net positive payout corresponding to the plurality of outcomes, wherein the net positive payout comprises the sum of payouts for each of the outcomes less a price paid for the plurality of outcomes.

9. The gaming device of claim 1, wherein when executed by the processor, the plurality of instructions cause the processor to:

determine a payout corresponding to at least one outcome of the plurality of outcomes; and store an indication of the payout.

10. The gaming device of claim 9, wherein the indication of the payout is stored on a medium other than the memory device.

11. The gaming device of claim 9, wherein when executed by the processor, the plurality of instructions cause the processor to receive at least one of a payment and an indication of payment for the plurality of outcomes.

12. The gaming device of claim 1, wherein when executed by the processor, the plurality of instructions cause the processor to generate the plurality of outcomes in response to the instruction at a speed that is greater than a speed at which the wagering game outcome is randomly generated for the play of the wagering game.

13. The gaming device of claim 1, wherein when executed by the processor, the plurality of instructions cause the processor to output an indication associated with the generated plurality of outcomes.

14. The gaming device of claim 13, wherein the indication comprises data that represents at least a sum of any payouts corresponding to the plurality of outcomes.

15. The gaming device of claim 13, wherein the data is in the form of a machine-readable bar code.

16. The gaming device of claim 13, wherein the indication comprises data readable by another device, the data enabling the other device to determine a video representation of another plurality of outcomes, wherein a sum of payouts corresponding to the other plurality of outcomes equals the sum of payouts corresponding to the generated plurality of outcomes.

17. The gaming device of claim 16, wherein at least one outcome of the other plurality of outcomes is at least one outcome of the generated plurality of outcomes.

18. A method of operating a gaming system including a plurality of instructions, said method comprising:

causing at least one processor to execute the plurality of instructions to randomly generate a first plurality of outcomes at a first location, each outcome being a result of a wagering game and being determined based on a random number;

before any of the generated outcomes are viewed by a player, causing the at least one processor to execute the plurality of instructions to facilitate a video to be created at a second location that is different from the first location, the video being a sequential output of each of the first plurality of generated outcomes;

causing the at least one processor to execute the plurality of instructions to facilitate a provision of the video to the player, for viewing of the video by the player at a third location that is different from both the first location and the second location.

19. The method of claim 18, wherein facilitating the provision of the video comprises facilitating a sale of a DVD, the DVD storing the video.

* * * * *

UNITED STATES PATENT AND TRADEMARK OFFICE

CERTIFICATE OF CORRECTION

PATENT NO. : 7,846,017 B2
APPLICATION NO. : 11/327215
DATED : December 7, 2010
INVENTOR(S) : Walker et al.

It is certified that error appears in the above-identified patent and that said Letters Patent is hereby corrected as shown below:

IN THE CLAIMS:

In Claim 2, column 44, line 37, replace “the second outcome” with --a second outcome--.

Signed and Sealed this
Eighth Day of March, 2011

David J. Kappos

David J. Kappos
*Director of the United States Patent and Trademark Office*